US007877030B2

(12) United States Patent
Horie et al.

(10) Patent No.: US 7,877,030 B2
(45) Date of Patent: Jan. 25, 2011

(54) IMAGE FORMING APPARATUS

(75) Inventors: Juun Horie, Tokyo (JP); Takeshi Yamamoto, Yokohama (JP); Manami Haraguchi, Yokohama (JP); Kenta Kubo, Kamakura (JP); Tomoaki Miyazawa, Tokyo (JP); Hirokazu Usami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/535,803

(22) Filed: Aug. 5, 2009

(65) Prior Publication Data

US 2010/0034564 A1 Feb. 11, 2010

(30) Foreign Application Priority Data

Aug. 6, 2008 (JP) ..... 2008-203656
Aug. 4, 2009 (JP) ..... 2009-181972

(51) Int. Cl.
*G03G 15/06* (2006.01)

(52) U.S. Cl. ..... 399/55; 399/285

(58) Field of Classification Search ..... 399/53, 399/55, 222, 252, 279, 285
See application file for complete search history.

(56) References Cited

U.S. PATENT DOCUMENTS 5,532,801 A 7/1996 Mizoguchi ..... 399/232
5,532,803 A * 7/1996 Yasuda et al. ..... 399/276
5,724,633 A 3/1998 Amemiya ..... 399/223

FOREIGN PATENT DOCUMENTS

JP 2000-056547 2/2000

OTHER PUBLICATIONS

Search Report dated Nov. 16, 2009, 5 pages in EP09167377.2-2209.

* cited by examiner

*Primary Examiner*—David P Porta
*Assistant Examiner*—Benjamin Schmitt
(74) *Attorney, Agent, or Firm*—Fitzpatrick, Cella, Harper & Scinto

(57) ABSTRACT

An image forming apparatus includes a developer carrying member to which a developing bias is applied. A frequency f of a developing bias waveform, a developing area S1 which is a time-integrated value of a difference between a voltage value of the developing bias and a solid electrostatic image potential VL in a developing period of the developing bias, a collecting area S2 which is a time-integrated value of a difference between the voltage value of the developing bias and VL in a collecting period of the developing bias, and a developing contrast value Vcon are used for defining a range of a value of the developing bias frequency f, a range of a value of a voltage change rate α at VL during transition of the developing bias voltage value from a developing-side voltage to a collecting-side voltage, and a range of a value represented by the formula:

$$\{(S1-1.28\times S2)\times f/Vcon\}\times \exp(-2.0\times 10^{-5}\times f/Hz).$$

5 Claims, 11 Drawing Sheets

IMAGE FORMING APPARATUS

FIELD OF THE INVENTION AND RELATED ART

The present invention relates to an image forming apparatus of an electrophotographic type such as a copying machine or a printer. Particularly, the present invention relates to an image forming apparatus including a developing device for developing an electrostatic image formed on an image bearing member by carrying a two component developer containing toner and a carrier on a developer carrying member and then applying to the developer carrying member a developing bias in the form of superimposed DC and AC voltages.

In a conventional image forming apparatus of an electrophotographic type such as a copying machine or a printer, an electrostatic (latent) image is formed on an image bearing member, having a surface photosensitive layer constituted by a photoconductor such as an OPC (organic photoconductor) photosensitive member or an amorphous silicon photosensitive member, through a process including charging and light exposure. Then, to the electrostatic image, toner is provided by using developer fed to a developing area by a developing device, a toner image is formed on the image bearing member. Further, the toner image on the image bearing member is transferred onto a transfer material directly or via an intermediary transfer member. Thereafter, the toner image is fixed on the transfer material to obtain a recorded image.

An image forming apparatus shown in FIG. 1 includes a drum-like photosensitive member 3, having a surface photosensitive layer, as the image bearing member (hereinafter referred to as a photosensitive drum). Around the photosensitive drum 3, a developing device 20 is disposed. The developing device 20 includes a two component developer 1 containing toner and magnetic particles (carrier) as the developer and includes a developing sleeve 21 in which a magnet member 21*a* is disposed as a developer carrying member. The developing device 20 further includes a developing bias oscillating device 40 including a developing bias waveform signal oscillator 41 and a high voltage source (high voltage transformer) 42 for amplifying a signal generated by the developing bias waveform signal oscillator 41 and applying a developing bias to the developing sleeve 21. The developer 1 is magnetically carried by the magnetic member 21*a* disposed inside the developing sleeve 21 and is fed to a developing area A, at which the developing sleeve 21 and the photosensitive drum 3 oppose each other, by rotating the developing sleeve 21. Further, the toner is subjected to triboelectric charge with the carrier by stirring of the developer 1 with a stirring screw 22 disposed inside the developing sleeve 20 or compression or the like of the developer at a feeding regulation portion by a developer layer thickness regulating member 23, thus being electrically charged to a predetermined charge amount. At this time, generally, the carrier is electrically charged to an opposite polarity to the charge polarity of the toner, so that the toner and the carrier are electrostatically attracted to each other. Therefore, when the carrier is fed to the developing area A by the developing sleeve 21, the toner is also fed to the developing area A together with the carrier.

When the charged toner is fed to the developing area A by the carrier, the toner is acceleratingly in accordance with an electric field produced by a potential difference between a developing bias potential applied to the developing sleeve 21 and a latent image potential at the photosensitive drum surface. At this time, as the developing bias, an alternating bias comprising an AC voltage and a DC voltage is used wisely. As a first effect using the alternating bias as the developing bias, there is an effect such that a developing efficiency is improved compared with a simple DC bias. This may be attributable to an increased maximum of the potential difference between the developing bias potential and the latent image potential at the photosensitive drum surface by increasing a peak-to-peak voltage Vpp of the alternating bias to increase an amount of toner which is separated from the carrier and contributes to development.

Further, as a second effect using the alternating bias as the developing bias, there is an effect such that an output image with good image uniformity. By using the alternating bias, in a bias period, it is possible to alternately provide a developing period in which the toner is acceleratingly moved toward the photosensitive drum side by the electric field produced in the developing area A and a collecting period in which the toner is acceleratingly moved toward the developing sleeve side.

In this case, the toner is alternately subjected to an acceleratingly electric field toward the photosensitive drum side (developing side) and an acceleratingly electric field toward the developing sleeve side (collecting side), so that the toner develops the electrostatic image on the photosensitive drum 3 while producing reciprocating motion in the developing area A.

The toner subjected to the development is re-arranged on the photosensitive drum 3, so that a finally formed toner image faithfully reproduces the electrostatic image to result in an image with good image uniformity. Particularly, at a low density portion (half-tone portion), compared with a maximum density portion (solid portion), density non-uniformity of the toner image is more liable to be recognized, so that development of the electrostatic image with the toner in a particularly faithful manner is important for improving an image quality.

In FIG. 2, a dotted (broken) line schematically represents a latent image potential of the electrostatic image formed with a digital latent image at a high density portion and a low density portion. A solid line represents a potential of the alternating developing bias. Further, a circle represents a position of a toner particle and schematically illustrates a state in which toner electric charges are filled in a latent image potential area. FIG. 2 is a schematic view showing the case where the toner is positively charged.

In FIG. 2, VL represents a latent image potential at a maximum density portion (solid portion), Vdc represents a DC component of the developing bias, VD represents a potential at a non-image portion (solid white portion), and Vpp represents a peak-to-peak voltage of the developing bias. In FIG. 2, when the developing bias potential is higher than VD, the toner is acceleratingly moved toward the photosensitive drum side and when the developing bias potential is lower than VL, the toner is acceleratingly moved toward the developing sleeve side. The toner repeatedly produces reciprocating motion between the photosensitive drum and the developing sleeve by the alternating developing bias, so that the toner particles are rearranged in the latent image potential area as indicated by arrows in FIG. 2, thus faithfully developing the electrostatic image.

In order to realize the good uniformity of the toner image formed after the development, it is necessary to provide the toner electric charges exactly and uniformly at the low density portion where the density non-uniformity is particularly liable to be conspicuous until the latent image potential reaches the potential Vdc. For this reason, the re-arrangement of the toner particles by the alternating developing bias produces a great effect of improving the image uniformity.

As a conventional waveform of the developing bias applied to the developing 21, a rectangular wave, a saw tooth wave, a rectangular duty wave, and a bias waveform including a normal rectangular wave and then including a rest period of the AC voltage, and the like are known. The rectangular duty wave refers to such a waveform that a voltage change in AC waveform is rectangular and a voltage value of an alternating voltage waveform is different between in a period in which the voltage value is on the developing side based on Vdc and in a period in which the voltage value is on the collecting side based on Vdc.

Incidentally, in recent years, electrophotography has been expected, more than ever, to provide near-printing machine properties such as a high image quality, a high speed, high stability, and low running cost. This is because with POD (print on demand) market expansion, demand for printing in a small amount on materials of various types and sizes grows. The electrophotography is a technology suitable for the printing in a small amount on materials of various types and sizes by a characteristic thereof, compared with a conventional offset printing, so that entry to the POD market has been tried.

In such circumferences, a proposal that an increase in toner coloring power so as to decrease an amount of toner (per unit area) necessary to form an image is very effective in realizing a high image quality of an output image, a high printing speed, and a low running cost has been made.

For example, by decreasing the toner amount (per unit area), a degree of a stepped toner portion which has conventionally problematic in the output image obtained through the electrophotography is reduced, so that it is possible to obtain a higher quality output image. Further, by decreasing the toner amount, a temperature required for fixing is lowered, so that it is possible to increase the number of sheets fixable with the same electric power consumption as that of a conventional image forming apparatus thereby to improve a printing speed. Further, an amount of toner consumption per sheet on which a color image is formed is reduced, so that it is possible to decrease the running cost and the decrease in toner amount is also effective in saving resources.

In the case of decreasing the toner amount, when an image density is intended to be controlled by increasing the toner coloring power so as to simply lower a developing contrast, it is known that an image tone gradation characteristic provides a high γ (gamma) value. In the case where the tone gradation characteristic provides the high γ value, the tone gradation characteristic of the output image can be non-continuous by mechanical and electrical fluctuations. Further, when the developing contrast is lowered, image defects such as a deterioration of the image uniformity and a deterioration of a degree of fog become problematic. For this reason, in order not to cause the high γ value and the image defects, it is desirable that the developing contrast Vcon is 150 V or more.

In this way, in order to ensure the developing contrast Vcon of 150 V or more while decreasing the toner amount, a proposal that it is effective to make an average toner charge amount larger than a conventional average toner charge amount has been made.

For example, now, as a toner amount per unit area (M/S) on the photosensitive drum at the time when the image density is a maximum density, M/S=0.6 mg/cm$^2$ is employed. At this time, a developing contrast Vcon at the high density portion is taken as Vcon=150 V. The average toner charge amount Q/M in the case of satisfying a charging efficiency of 100% can be obtained by the following formula as |Q/M|=19.5 μC/g.

$$|Q/M| = \frac{Vcon}{\left(\frac{Lt}{2\varepsilon_0\varepsilon_t} + \frac{Ld}{\varepsilon_0\varepsilon_d}\right)(M/S)}$$

The developing contrast means a potential difference between a high density developing latent image potential VL and a DC voltage component Vdc of the developing bias, i.e., Vcon=|VL−Vdc|. Further, the charging efficiency refers to a ratio of a charging potential ΔV, at which the toner charges are filled, to the portion contrast Vcon, i.e., (charging efficiency)=ΔV/Vcon×100%.

Further, in the above formula, Lt is a height of a toner layer subjected to development on the photosensitive drum and is 9.2 mm; εt is a dielectric constant of the toner layer and is 2; Ld is a thickness of a photosensitive layer and is 30 μm; Ed is a dielectric constant of the photosensitive member and is 3.3; and ε0 is an electric constant and is $8.854\times10^{-12}$ F/m.

Next, by using the toner increased in coloring power, a situation in which the toner amount (per unit area) on the photosensitive drum is decreased will be considered.

In order not to provide the high γ value due to the decrease in developing contrast, the toner amount M/S is decreased to 0.4 mg/cm$^2$ while the developing contrast Vcon is kept at 150 V. For this purpose, by a calculation similar to that described above, an absolute value of the average toner charge amount (|Q/M|) has to be 31.1 μC/g. However, the toner amount is decreased in this case, so that the height Lt of the toner layer subjected to development on the photosensitive drum is changed to 6.4 μm in the above calculation.

As described above, in the case where the toner amount is considerably decreased while maintaining an image property equivalent to a conventional image property, it is essential to employ, as the developer, toner electrically charged to 30 μC/g or more as an absolute value of the average charge amount.

Further, according to consideration by the present inventors, in the image forming apparatus using the two component developing method, it is desirable that the absolute value of the average charge amount of the toner is 100 μC/g or less. The reason therefor is as follows.

When the charge amount of the toner is increased, electric charges of an opposite polarity of the carrier are correspondingly increased, so that an electrostatic adhesion force between the toner and the carrier is increased. In order to separate the toner having the charge amount of, e.g., more than 100 μC/g from the carrier by the electric field and then to subject the toner to development on the photosensitive drum, an electric field intensity on the order of $5\times10^6$ to $10\times10^6$ V/m is needed. However, this electric field intensity is an electric field intensity area in which leakage is liable to occur. When electric discharge occurs between the developing sleeve and the photosensitive drum, there is a possibility of not only disturbance of the toner image but also breakage of the photosensitive drum itself. For this reason, a voltage to be applied to the developing sleeve in order to ensure an electric field necessary to subject the toner to the development cannot be increased without limitation. For the above-described reason, in the image forming apparatus using the two component developing method, it is desirable that the absolute value of the average charge amount of the toner is 100 μC/g or less.

As described above, in the case where the toner amount is considerably decreased in the image forming apparatus using the two component developing method, it is possible to maintain the image property equivalent to the conventional image property by setting the average charge amount Q/M in the range of: 30 μC/g≦|Q/M|≦100 μC/g.

However, as described above, the electric charging of the toner in the developing device is performed by the triboelectric charge with the carrier and therefore when the toner charge amount is increased, the electrostatic adhesion force is also increased. For this reason, when the toner charge amount is increased in order to decrease the toner amount, the developing efficiency is considerably deteriorated, so that a sufficient image density is less liable to be obtained in the image forming apparatus employing a conventional developing bias.

As a feature of an output image in the case of subjecting the toner, electrically charged to have the average charge amount of 30 μC/g or more in terms of the absolute value, to the development by using the above-described known developing bias, it is possible to form an image with relatively good uniformity in the case where a waveform indicated by a solid line in FIG. 3 is used as the developing bias. However, it has been cleared that the sufficient image density cannot be obtained.

However, the waveform indicated by the solid line in FIG. 3 is an output waveform obtained by amplification with a high voltage source so as to provide a peak-to-peak voltage of 1.3 kV by using a waveform signal indicated by a dotted (known) line as an input waveform. The dotted waveform signal is such a waveform that a rectangular pulse is applied for two periods and thereafter a rest period corresponding to 6 periods of the rectangular pulse is provided, wherein a frequency for one pulse is 12 kHz.

Further, a waveform indicated by the solid line in FIG. 4 is an output waveform obtained by amplification with the high voltage source by using a rectangular duty waveform indicated by the dotted line as the input signal. In the case where the development is effected by using this output waveform, an image having a relatively high image density can be obtained by optimizing a duty ratio or a frequency but it has been found that the image uniformity is considerably deteriorated. This is because a peak voltage on the toner collecting side is decreased in the case of the rectangular duty wave compared with an ordinary rectangular wave, so that a toner collecting effect is lowered. As a result, it is considered that an amount of the toner subjected to the development is increased but at the same time an effect of re-arrangement by transfer-back from the photosensitive drum is weaken to result in deterioration in image uniformity.

A waveform indicated by the dotted line in FIG. 5 is waveform described in Japanese Laid-Open Patent Application (JP-A) 2000-56547. This waveform is characterized in that at least two (former and latter) voltage change portions different in slope of the voltage change are provided during transition of the peak voltage from the developing side to the collecting side so that the slope of the voltage change at the latter voltage change portion is gentler than that at the former voltage change portion.

According to JP-A 2000-56547, by using the above-described waveform as the developing bias, it has been reported that not only a sufficient image density but also a smooth image can be obtained.

However, according to study by the present inventors, in the case where the toner charge amount is considerably larger than those in embodiments of JP-A 2000-56547, even when the waveform indicated by the dotted line in FIG. 5 is used as the input signal and a waveform, indicated by the solid line in FIG. 5, which has been outputted by the high voltage source is used as the developing bias, it has been found that an effect of obtaining good image uniformity cannot be sufficiently achieved while improving the image density.

As described above, it has been found that a problem arises when the known waveform is employed as the alternating developing bias in the case where the toner having the average toner charge amount satisfying: 30 μC/g≦|Q/M|≦100 μC/g is subjected to the development by using the two component developing method. That is, in this case, it is difficult to obtain the sufficient image density and the image with good uniformity in a compatible manner.

SUMMARY OF THE INVENTION

A principal object of the present invention is to provide an image forming apparatus capable of providing a sufficient image density and an image with good image uniformity even in the case of using a two component developer containing toner having an average charge amount Q/M satisfying: 30 μC/g≦|Q/M|≦100 μC/g.

According to an aspect of the present invention, there is provided an image forming apparatus comprising:

an image bearing member for bearing an electrostatic image; and a developing device, including a developer carrying member for carrying a developer including a magnetic carrier and toner having an average charge amount Q/M satisfying: 30 μC/g≦|Q/M|≦100 μC/g and for feeding the developer toward an opposite portion between the developing device and the image bearing member, for developing the electrostatic image by applying to the developer carrying member a developing bias comprising a DC voltage component and an AC voltage component;

wherein the developing bias has a waveform portion including a collecting period, in which a voltage produces an electrostatic force for moving the toner toward the developer carrying member, and including a developing period in which a voltage produces an electrostatic force for moving the toner toward the image bearing member, and wherein the waveform portion satisfies the following formulas (1), (2), and (3):

$$5\ \text{kHz} \leqq f \leqq 10\ \text{kHz} \tag{1}$$

$$0.42 \times Vpp/T \leqq |\alpha| \leqq 0.89 \times Vpp/T \tag{2}$$

$$\{(S1 - 1.28 \times S2) \times f/V\text{con}\} \times \exp(-2.0 \times 10^{-5} \times f/1\ \text{Hz}) \geqq 0.82 \tag{3}$$

wherein f represents a frequency of the waveform portion,

α represents a change rate of voltage per time at the time when a voltage value of the developing bias is equal to an electrostatic image potential VL, at a maximum density portion of an image formed on the image bearing member, during transition from the developing period to the collecting period, Vpp represents a peak-to-peak voltage which is a difference between a peak voltage in the developing period of the developing bias and a peak voltage in the collecting period of the developing bias, T represents a period of the waveform portion and is 1/f, S1 represents a time-integrated value of a difference between the voltage value of the developing bias and the electrostatic image potential VL in the developing period of the developing bias, S2 represents a time-integrated value of a difference between the voltage value of the developing bias and the electrostatic image potential VL in the collecting period of the developing bias, and Vcon represents a developing contrast value represented by Vcon=|Vdc|VL| where Vdc represents the DC voltage component of the developing bias.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a schematic diagram of a developing area S1, a collecting area S2, and a.

DESCRIPTION OF THE PREFERRED EMBODIMENTS

Hereinbelow, the image forming apparatus according to the present invention will be described with reference to the drawings.

Embodiment 1

The image forming apparatus according to the present invention is implementable by the electrophotographic image forming apparatus using the two component developing method described above with reference to FIG. 1.

Figure 1:
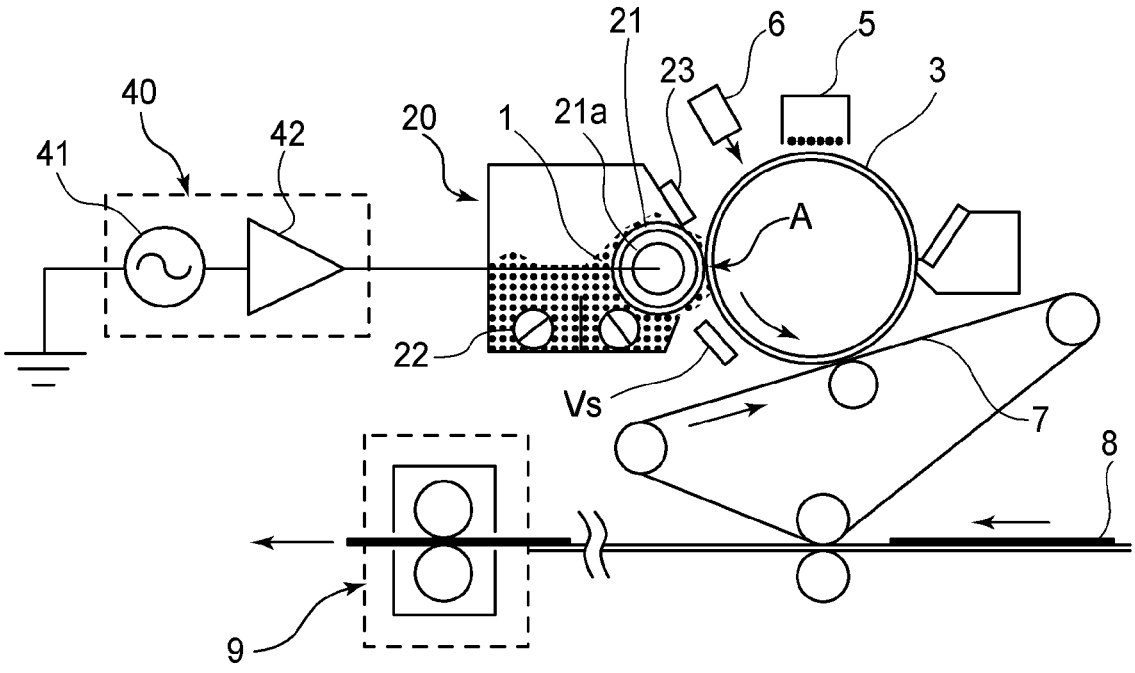
FIG. 1 is a schematic view showing an embodiment of an image forming apparatus of a two component developing type according to the present invention.
Figure 2:
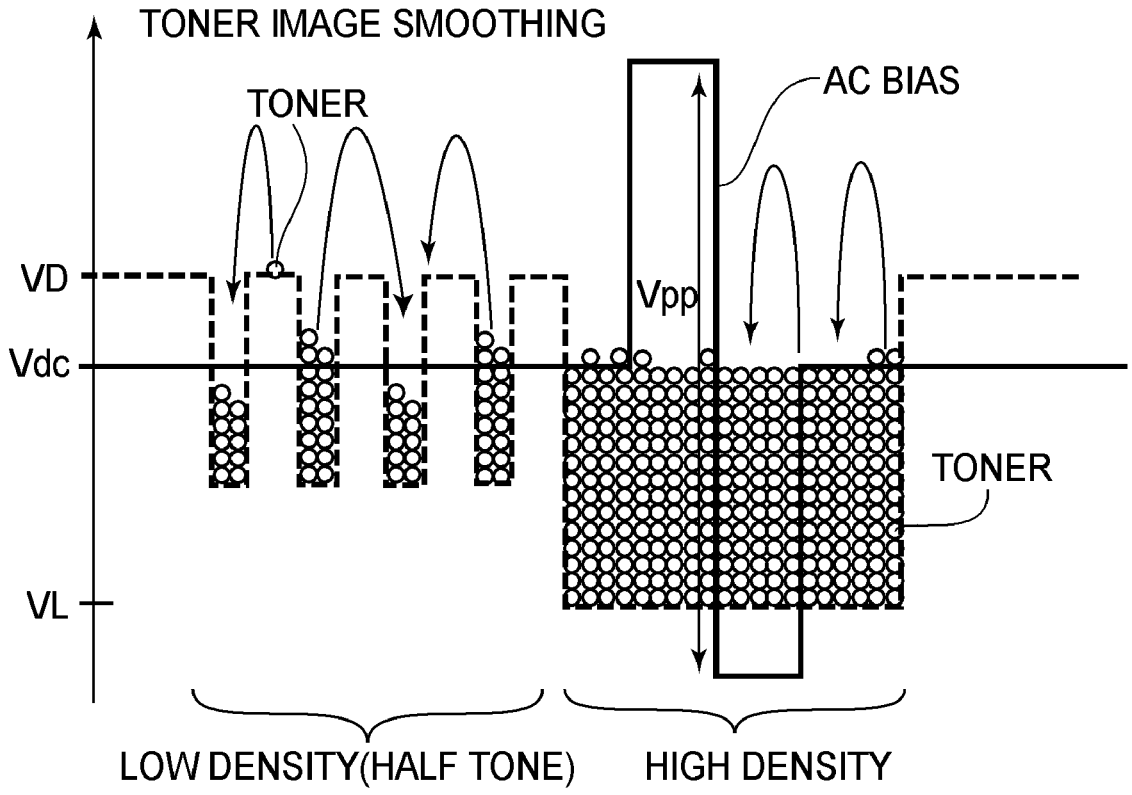
FIG. 2 is a schematic view for illustrating a low density portion latent image potential and a toner re-arrangement effect.

Referring to FIG. 1, in this embodiment, the image forming apparatus includes a drum-like photosensitive member having an OPC (organic photoconductor) photosensitive layer as an image bearing member, i.e., the photosensitive drum 3. Around the photosensitive drum 3, the charging device 5 as the charging means for electrically charging the photosensitive drum 3 uniformly and the exposure device 6 as the exposure means for imagewise-exposing the uniformly charged photosensitive drum 3 to light to form the electrostatic image are provided. Further, around photosensitive drum 3, a developing device 20 as the developing means for developing the electrostatic image on the photosensitive drum 3 is also disposed. The developing device 20 includes a two component developer 1 containing toner and magnetic particles (carrier) as the developer and includes a developing sleeve 21 in which a magnet member 21*a* is disposed as a developer carrying member. The developing device 20 further includes a developing bias oscillating device 40 including a developing bias waveform signal oscillator 41 and a high voltage source (high voltage transformer) 42 for amplifying a signal generated by the developing bias waveform signal oscillator 41 and applying a developing bias to the developing sleeve 21. The developer 1 is magnetically carried on the developing sleeve 21 by the magnetic member 21*a* disposed inside the developing sleeve 21 and is fed to a developing area A, at which the developing sleeve 21 and the photosensitive drum 3 oppose each other, by rotating the developing sleeve 21. Further, the toner is subjected to friction with the carrier by stirring of the developer 1 with a stirring screw 22 in the developing sleeve 20 or compression or the like of the developer by a developer layer thickness regulating member 23, thus being negatively charged.

Further, as described above, the electrostatic image is formed at a portion upstream of the developing area A with respect to the photosensitive drum 3 by the electric charging of the photosensitive layer with the charging device 5 and the exposure with the exposure device 6. Then, by applying the alternating developing bias to the developing sleeve 21, the toner is provided to the formed electrostatic image at the opposite portion between the developing sleeve 21 and the photosensitive drum 3 to form the toner image.

The toner image formed on the photosensitive drum 3 is primary-transferred onto the intermediary transfer member (intermediary transfer belt) 7 at the downstream portion of the photosensitive drum 3 and then is secondary-transferred onto the conveyed transfer material 8 at the downstream portion of the intermediary transfer member 7. The transfer material 8 is further conveyed to the fixing device 8 by which the toner image on the transfer material 8 is fixed on the transfer material 8, so that a final output image is obtained.

Figure 6:
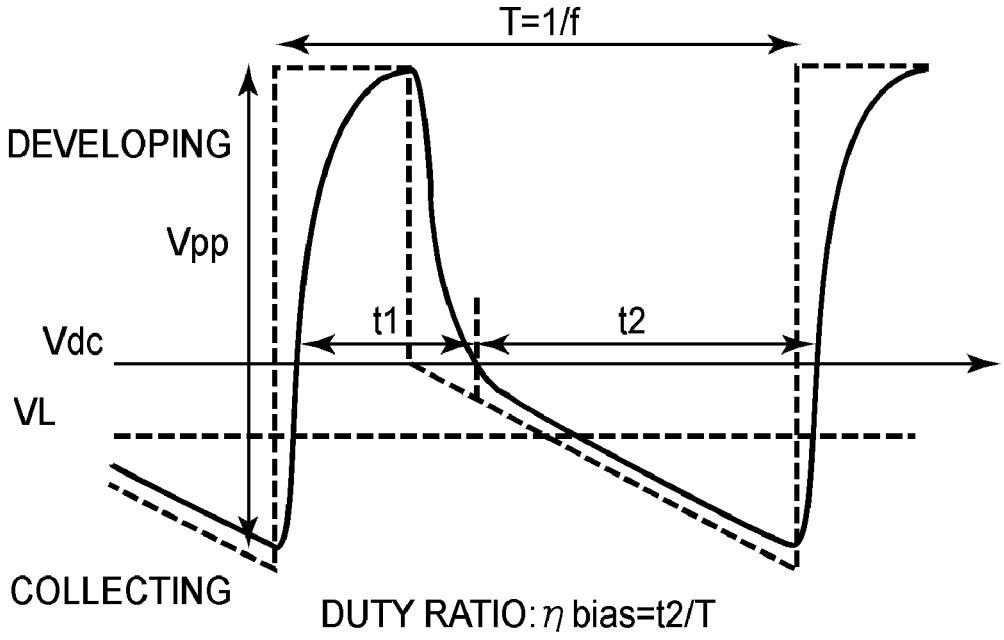
FIG. 6 is a diagram showing a DS bias waveform.

In this embodiment, a developing bias having a DS bias waveform indicated by the solid line in FIG. 6 is used. This developing bias is formed by the DC voltage and the AC voltage in a superposition manner.

In this case, the developing bias waveform is obtained by amplifying an input signal waveform, indicated by the dotted line in FIG. 6, with the high voltage source. This input signal waveform is characterized in that a voltage change in a developing period with respect to a DC voltage component Vdc is a rectangle-like and has a certain slope in a collecting period with respect to the DC voltage component Vdc.

Hereinafter, this input signal waveform is referred to as a DS signal waveform (DS: developing-side rectangular duty and collecting-side slope) and the developing bias waveform obtained by amplifying the DS signal waveform is referred to as a DS bias waveform.

The DS signal waveform and the DS bias waveform are characterized by a waveform period T (or a frequency f) and a duty ratio $\eta$bias.

Here, the definition of the duty ratio ηbias will be described with reference to FIG. 6. In FIG. 6, t1 represents a period in which a waveform portion of the developing bias is located in the developing side with respect the Vdc and t2 represents a period in which the waveform portion of the developing bias is located in the collecting side with respect to Vdc. In the period t1, an electrostatic force for moving the toner toward the developer carrying member is produced. In the period t2, an electrostatic force for moving the toner toward the image bearing member is produced. The duty ratio ηbias is defined as a ratio of the period t2 to one period T of the waveform portion, i.e., ηbias=t2/T. In this case, a value of Vpp (peak-to-peak voltage) and a ratio between t1 and t2 are determined so that a time-integrated value of the waveform in the period t1 with respect to Vdc as a reference axis is equal to a time-integrated value of the waveform in the period t2 with respect to Vdc as the reference axis. Incidentally, when the DS waveform is obtained by the high voltage source, depending on a rise time of the high voltage source, the DS bias waveform is duller than the DS signal waveform. Therefore, it should be noted that a duty ratio calculated from the DS signal waveform (referred to as ηsign) is not coincides with the duty ratio ηbias calculated from the DS bias waveform. For example, in the case of the FIG. 6, when the input signal waveform (indicated by the dotted line) has a frequency f of 6 kHz, the duty ratio ηsign is 0.75 but the duty ratio ηbias calculated from the DS bias waveform (indicated by the solid line) is 0.65 by the influence of the rise time of the high voltage source.

Figure 5:
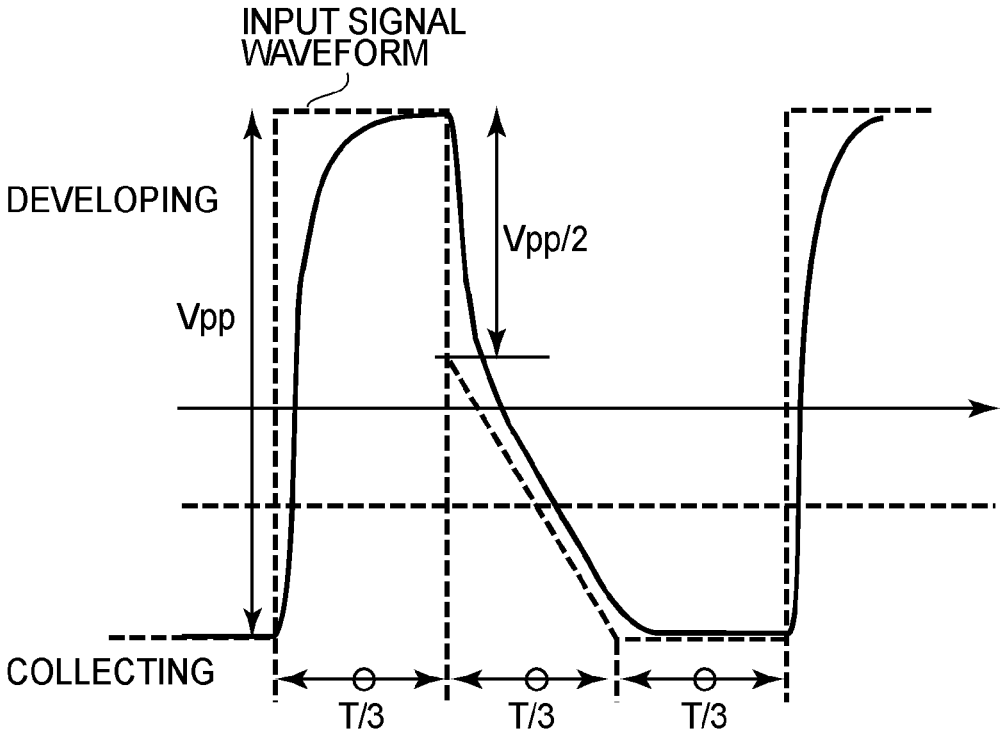
FIG. 5 is a diagram showing a developing bias waveform described in an embodiment of JP-A 2000-56547.

Further, when Vpp=1050 V and Vcon=250 V, in the DS bias waveform shown in FIG. 6, $\{(S1-1.28\times S2)\times f/Vcon\}\times \exp(-2.0\times10^{-5}\times f/Hz)$ is 0.863 and $|\alpha|$ is 3.46 (kV/msec)=0.55×Vpp/T. Accordingly, the DS bias waveform shown in FIG. 5 satisfies the following formulas (conditions) (1), (2) and (3):

$$5\ \text{kHz} \leqq f \leqq 10\ \text{kHz} \tag{1}$$

$$0.42\times Vpp/T \leqq |\alpha| \leqq 0.89\times Vpp/T \tag{2}$$

$$\{(S1-1.28\times S2)\times f/Vcon\}\times \exp(-2.0\times10^{-5}\times f/1\ Hz) \geqq 0.82 \tag{3}$$

wherein f represents a frequency (Hz) of the waveform portion,

α represents a change rate of voltage per time (kV/msec) at the time when a voltage value of the developing bias is equal to an electrostatic image potential VL, at a maximum density portion of an image formed on said image bearing member, during transition from the developing period to the collecting period, Vpp represents a peak-to-peak voltage (V) which is a difference between a peak voltage in the developing period of the developing bias and a peak voltage in the collecting period of the developing bias, T represents a period (sec) of the waveform portion and is 1/f, S1 represents a time-integrated value (V×msec) of a difference between the voltage value of the developing bias and the electrostatic image potential VL in the developing period of the developing bias, S2 represents a time-integrated value (V×msec) of a difference between the voltage value of the developing bias and the electrostatic image potential VL in the collecting period of the developing bias, and Vcon represents a developing contrast value (V) represented by Vcon=|Vdc−VL| where Vdc represents the DC voltage component of the developing bias.

Figure 7:
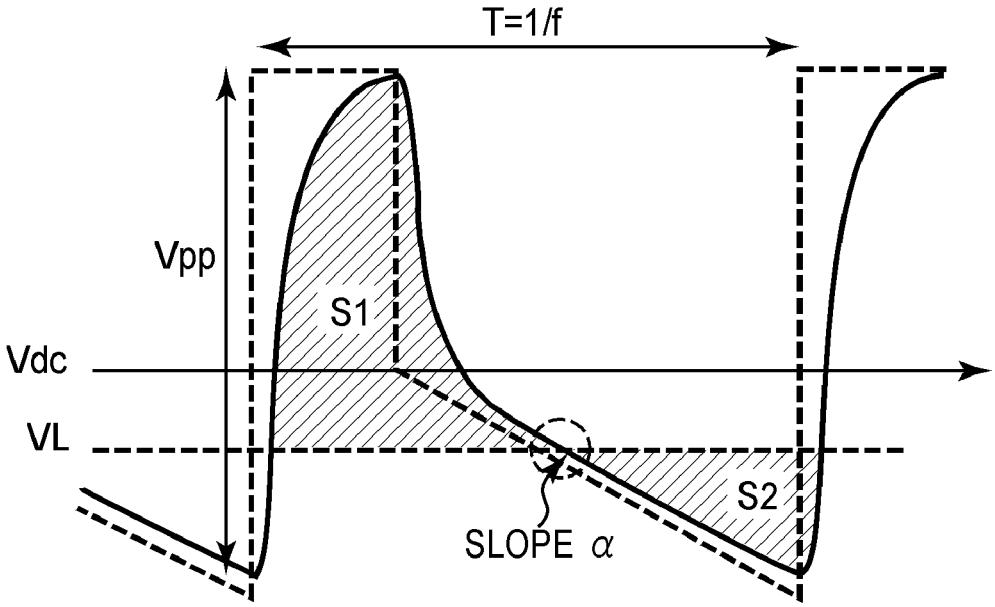
Figure 8:
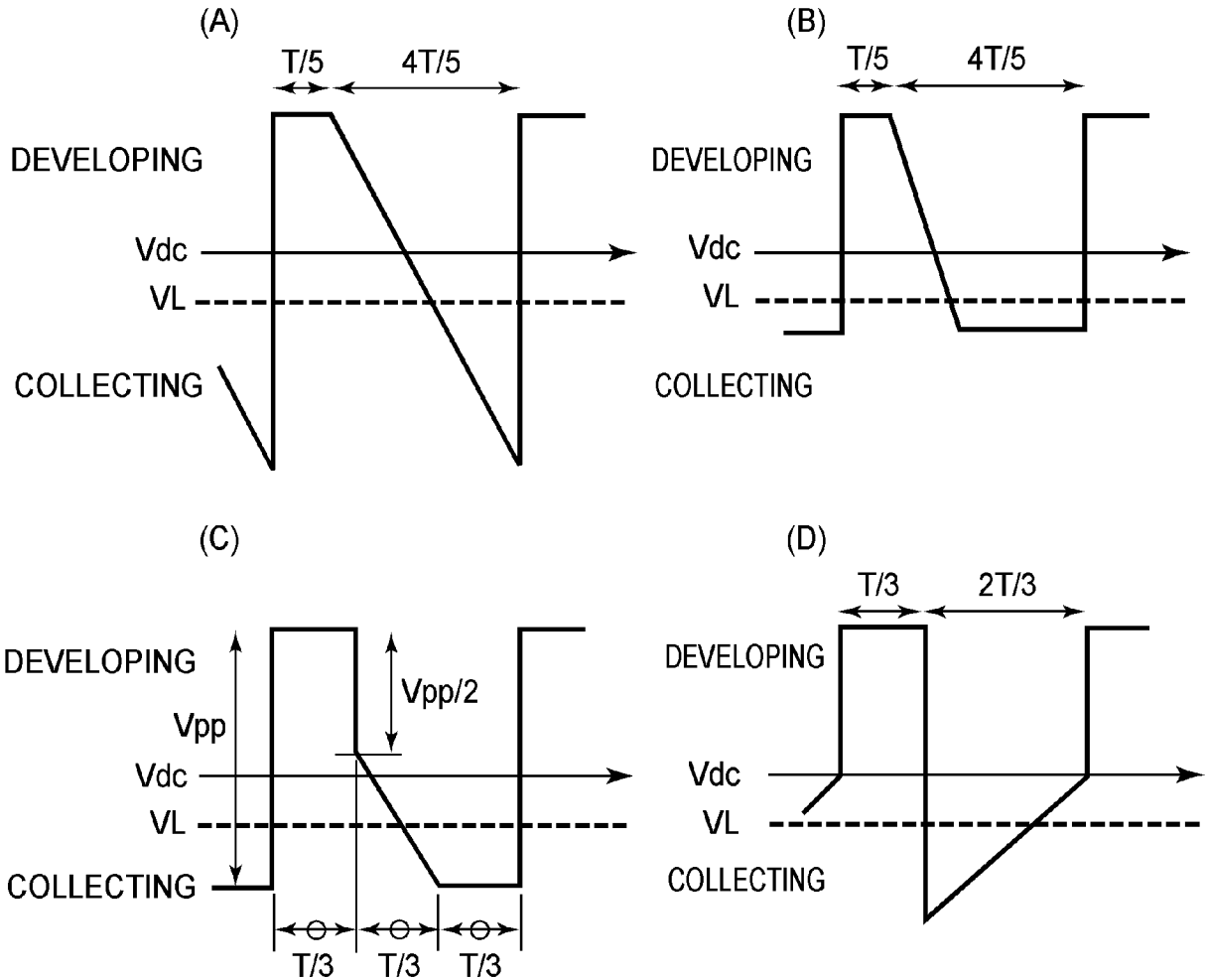
FIGS. 8(A) to 8(D) are diagrams showing input signal waveforms for obtaining developing bias waveforms used for image formation evaluation in Experiment 5.

Here, value of a developing area S1, and a collecting area S2 for obtaining the value of $\{(S1-1.28\times S2)\times f/Vcon\}\times \exp(-2.0\times10^{-5}\times f/Hz)$ can be determined by calculating corresponding portions indicated by oblique lines in FIG. 7 with respect to the DS bias waveform. Similarly, the voltage change rate α can be calculated from the DS bias waveform. Specific calculating methods of the developing area (time-integrated value) S, the collecting area (time-integrated value) S2, and the voltage change rate α will be described later.

In the above formula (2), a is a parameter regarding the developing bias waveform which dominates uniformity of the toner image to be formed by the development. As described above, the toner produces reciprocating motion between the photosensitive drum and the developing sleeve by the alternating developing bias, so that the toner particles are re-arranged on the electrostatic image to improve image uniformity. Therefore, the present inventors have expected that motion of the toner at the time of being acceleratingly moved toward the developing sleeve side have an influence on the re-arrangement of the toner particles. The present inventors have made study by focusing attention on the voltage change rate with time at the instant at which the voltage value of the developing bias reaches the potential VL of the electrostatic image, at the maximum image density portion (solid portion), formed on the image bearing member during the transition of the voltage value of the developing bias from the peak voltage value on the developing side to the peak voltage value on the collecting side. As a result, it has been found that the image uniformity is improved by decreasing a parameter |a|×T/Vpp obtained by normalizing the absolute value of the voltage-time change rate α by using the alternating developing bias period T and the alternating developing bias peak-to-peak voltage Vpp in the case where the frequency of the developing bias is 5 kHz or more. Hereinafter, the parameter is referred to as H, i.e., H=|α|×T/Vpp.

The above parameter H does not depend on the frequency f and the peak-to-peak voltage when the waveform form of the developing bias is the same, thus characterizing the waveform form. That is, the present inventors have clarified that a relative waveform form in one period of the alternating developing bias, not the value of the voltage-time change rate α itself, has the influence on the re-arrangement of the toner particles to determine the image uniformity of the finally formed toner image. Specifically, it has been clarified that an output image with good image uniformity can be obtained by using a developing bias waveform having α satisfying: 0.42≦H≦0.89 as a result of an experiment described later, i.e., the above-described formula (2).

The left side of the above-described formula (3) is a parameter which dominates the influence on the charging efficiency. A physical interpretation of the left side of the formula (3) will be described. First, in order to improve the developing property for the purpose of achieving a sufficient image density, it is necessary to provide the toner with momentum toward the developing side efficiently per unit time at the time of the development by which the reciprocating motion is produced between the photosensitive drum and the developing sleeve. That is, it is important that the momentum provided to the toner in the developing period in which the toner is acceleratingly moved toward the photosensitive drum side is increased and that in the collecting period in which the toner is acceleratingly moved toward the developing sleeve side is decreased.

The momentum provided to the toner is obtained by time integration of a force exerted on the toner by the electric field but the force by the electric field is considered that the force is proportional to a potential difference between the photosensitive drum and the developing sleeve. For this reason, the time-integrated value S1 of a difference between the developing bias voltage value and VL in the developing period in which the developing bias voltage value in present on the developing side with respect to VL is proportional to the momentum provided to the toner in the developing period. On the other hand, the time-integrated value S2 of a difference between the developing bias voltage value and VL in the collecting period in which the developing bias voltage value is present on the collecting side with respect to VL is proportional to the momentum provided to the toner in the developing period. By such inference, in the case where the AC frequency of the developing bias is f, momentum corresponding to f period is provided per unit time to the toner by the developing bias. Thus, momentum proportional to the formula: (S1−k×S2)×f per unit time is provided to the toner. In this formula, k is interpreted as a coefficient representing a difference in contribution to the developing property between the developing area S1 and the collecting area S2. Particularly, in the case of the two component developing method, the toner and the carrier are electrically charged to the polarities opposite to each other, so that an actual electric field exerted on the toner is shifted toward the side on which the toner is collected by the developer carrying member, due to the electrostatic adhesion force between the toner and the carrier. For this reason, a contribution ratio of the collecting area S2 to the final amount of the toner subjected to the development is larger than that of the developing area S1. Therefore, by multiplying S2 by a coefficient larger than 1, the difference in contribution ratio to the toner amount for the development between S1 and S2 is phenomenologically incorporated. Further, by dividing the above formula by Vcon, a normalized (nondimensional) formula: (S1−k×S2)×f/Vcon is provided. As a result, this normalized formula becomes a parameter for indicating that the developing bias can provide how much momentum per set Vcon to the toner, i.e., indicating a momentum providing efficiency of the developing bias waveform itself.

Incidentally, although the above parameter contains the frequency f in its formula, S1 and S2 are inversely proportional to the frequency f, so that the parameter does not depend on the frequency as a whole. However, in an actual phenomenon, when the developing bias frequency is increased, followability of the reciprocating motion of the toner with respect to the developing bias waveform is lowered, thus lowering the developing property. As shown in a result of an experiment described later, according to study by the present inventors, it is found that a property of the lowering in developing property in the developing bias frequency range of 3 to 12 kHz in which the image formation evaluation is made can be approximately by the following function:

$$F(f)=Fo\ \exp(-a\times f/1\ \mathrm{Hz}),$$

wherein Fo and a are constants.

From the above-described considerations, the present inventors have predicted that the parameter regarding the developing bias waveform which determines the developing property can be represented by:

$$\{(S1-k\times S2)\times f/Vcon\}\times\exp(-a\times f/Hz),$$

which is defined as a parameter G.

Further, from the result of the experiment described later, it has been clarified that the parameter G is proportional to the charging efficiency when k is 1.28 and a is $2.0\times10^{-5}$. Further, it is also clarified that when the parameter G is 0.82 or more, compared with the development using the conventionally known developing bias waveform, it is possible to considerably improve the developing property.

In this embodiment, as an image output apparatus, a modified machine of an image forming apparatus ("image PRESS C2", mfd. by CANON KABUSHIKI KAISHA) was used. A two component developer prepared by mixing 92 wt. parts of a magnetic carrier having an average particle size of 40 μm and 8 wt. parts of negatively chargeable cyan toner having an average particle size of 5.5 μm was added in a developing device located at a black position and then image formation was performed under a normal temperature/normal humidity (23° C./50% RH) environment. The formed image was outputted on CLC sheets (basis weight: 81.4 g/cm$^2$) as the transfer material.

In the image formation, a developing bias was produced in the following manner and was applied to a developing sleeve of the above-described image output apparatus. A waveform signal was prepared by using a software ("Arbitrary Waveform Editor 0105", available from NF Corporation) and was generated by using a function generator ("WF1946B", mfd. by NF Corporation) The generated waveform signal was amplified by using a high voltage source ("CAN-076", mfd. by NF Corporation) to prepare the developing bias.

An image forming condition included a photosensitive drum peripheral speed of 270 mm/sec, a maximum density portion electrostatic image potential VL of −150 V, and a non-image portion potential VD of −550 V. For measurement of VL and VD, as shown in FIG. 1, a surface electrometer Vs ("MODEL 347", mfd. by TREK, INC.) provided immediately below a developing portion was used.

The photosensitive drum 3 was subjected to charging and exposure in a state in which the developing device 20 was not disposed to form a solid portion for measuring the latent image potential VL and a solid black portion for measuring the latent image potential VD. Then, by using the surface electrometer Vs, values of VL and VD were measured.

The rotational direction of the developing sleeve 21 was set so that the developing sleeve surface and the photosensitive drum surface move in the same direction at an opposite portion between the developing sleeve 21 and the photosensitive drum 3. A peripheral speed of the developing sleeve 21 was 470 mm/sec. A density of the developer supplied to the developing area A was adjusted at 30 mg/cm$^2$. Further, a smallest distance between the photosensitive drum 3 and the developing sleeve 21 in the developing area A was 0.30 nm.

<Experimental Overview>

A brief overview of <Experiment 1> to <Experiment 5> conducted for determining conditions for carrying out the present invention will be described.

<Experiment 1>

Figure 3:
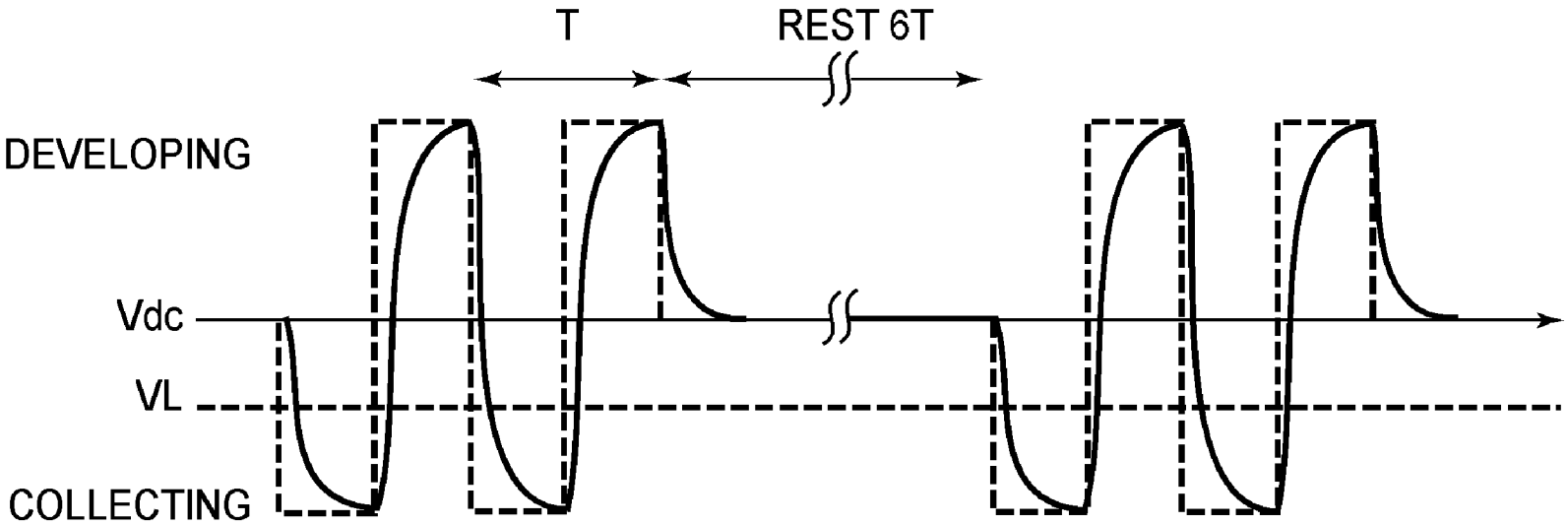
FIG. 3 is a diagram showing a known developing bias waveform used for image formation evaluation in Experiment 1.

In Experiment 1, image formation evaluation was made by using the developing bias waveform shown in FIG. 3 in which T was 83 msec. Then, in Experiment 2 to Experiment 5, validation of the use of the charging efficiency as a method of evaluating the image density was performed. Further, by using the developing bias shown in FIG. 3 as a reference developing bias, the output image was used as a reference image with respect to the image density and the image uniformity. By comparison with this reference image, with respect to output images in image formation evaluation made in Experiment 2 to Experiment 5, judgment as to whether or not a sufficient image density and good image uniformity were obtained was made.

<Experiment 2>

In Experiment 2, the duty ratio ηsign of the DS signal waveform as the input signal waveform changed in the range of 0.6≦ηsign≦0.8 and the frequency was changed in the range of 3 kHz≦f≦12 kHz. The respective DS signal waveforms were amplified by the high voltage source to provide DS bias waveforms, which were used for the image formation evaluation. The evaluation results showed an embodiment of the present invention and clarified a bias waveform condition for achieving an effect of the present invention.

<Experiment 3>

In Experiment 3, image formation evaluation providing the embodiment of the present invention shown by the evaluation results in Experiment 2 was performed by using a waveform obtained by providing a rest period of a certain AC waveform immediately after a developing period of the developing bias waveform including repetition of the developing period and a collecting period.

<Experiments 4 and 5>

Experiments 4 and 5 provide comparative embodiments in which similar image evaluation is performed by using several patterns of developing bias waveforms which do not satisfy the above-described conditions (1), (2) and (3) to substantiate that the effect of the present invention is first achieved by satisfying the conditions (1), (2) and (3) in the image forming apparatus of the present invention.

Particularly, in Experiment 4, with respect to the rectangular duty bias waveform as the input signal waveform, the duty ratio was changed in the range of 0.6≦ηsign≦0.8 and the frequency was changed in the range of 3 kHz≦f≦12 kHz. Further, the image formation evaluation was performed by using rectangular duty bias waveforms obtained by amplifying the respective rectangular duty signal waveforms with the high voltage source to provide the comparative embodiment for the embodiment provided by Experiment 2.

In Experiment 5, the image formation evaluation was performed by using bias waveforms obtained by amplifying signal waveforms shown in FIGS. 8(A), 8(B), 8(C) and 8(D) with the high voltage source to provide the comparative embodiment for the embodiment provided by Experiment 2.

Figure 9:
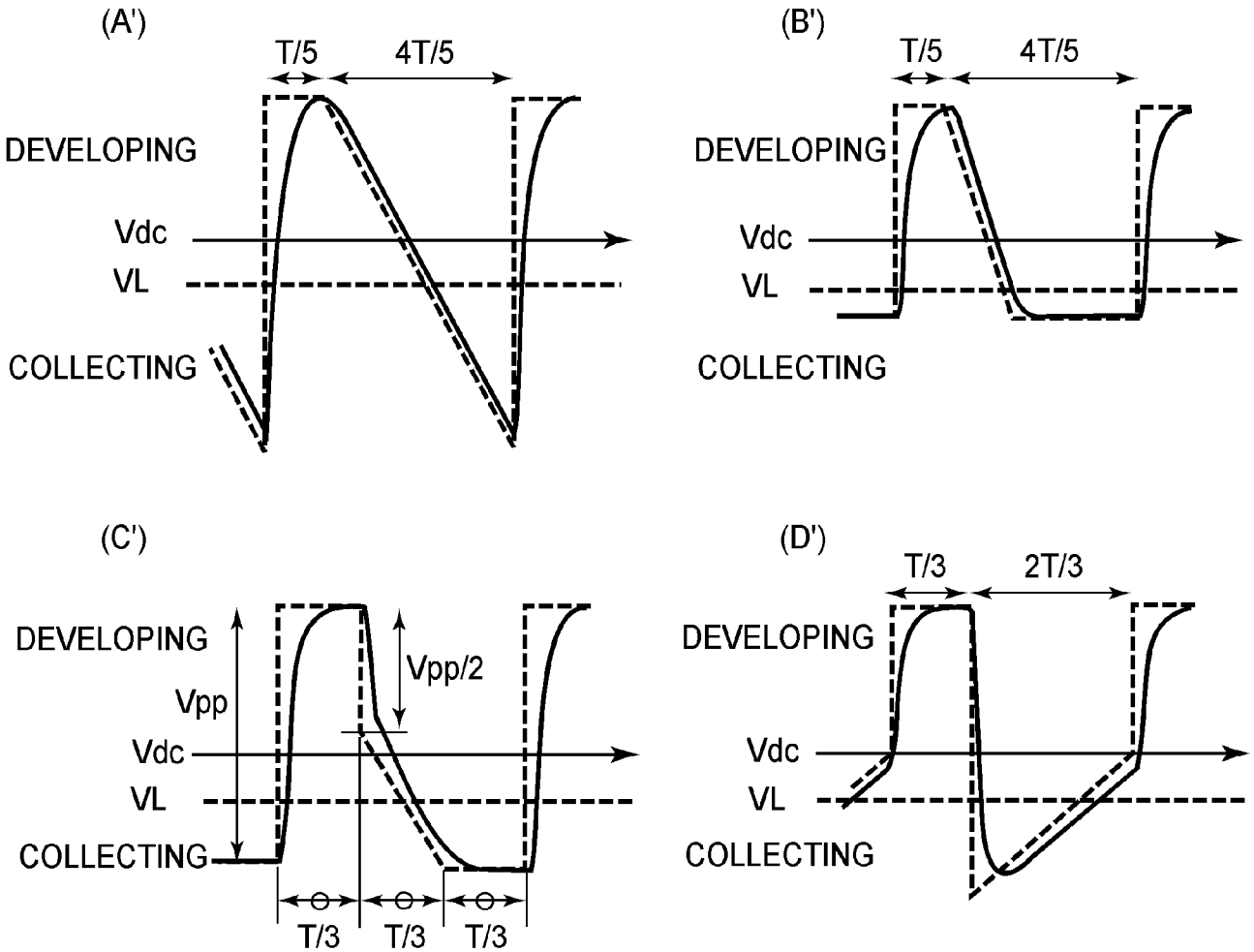
FIGS. 9(A') to 9(D') are diagrams showing the developing bias waveforms used for image formation evaluation in Experiment 5.

FIGS. 9(A'), 9(B'), 9(C') and 9(D') show bias waveforms obtained by amplifying the signal waveforms shown in FIGS. 8(A), 8(B), 8(C) and 8(D), respectively. The waveforms shown in FIGS. 9(A'), 9(B') and 9(C') are similar to the DS bias waveform in that the voltage change during the transition from the peak voltage on the developing side to the peak voltage on the collecting side has a slope at the time when the voltage value reaches VL but do not satisfy at least one of the conditions (1), (2) and (3). The waveform shown in FIG. 9(C') is the developing bias waveform described in the embodiment of JP-A 2000-56547. In the waveform shown in FIG. 9(D'), oppositely to the DS bias waveform, the slope of the voltage change during a period of transition from the peak voltage on the collecting side to Vdc was made gentle.

When the image formation evaluation was performed by using the respective developing bias, an average charge amount Q/M of the toner subjected to the development on the photosensitive drum was measured in a manner described below. As a result, even in the case of effecting the development by using either of the developing bias waveforms, the average toner charge amount Q/M was in the range from −54 μC/g to −56 μC/g. Thus, it was confirmed that |Q/M|≧30 μC/g was satisfied. Further, with respect to either of the developing bias waveforms used for the image formation evaluation, it was confirmed that there was no large difference in the charge amount of the toner subjected to the development.

<Q/M Measuring Method>

The charge amount of the toner subjected to the development on the photosensitive drum was measured in the following manner.

Figure 10:
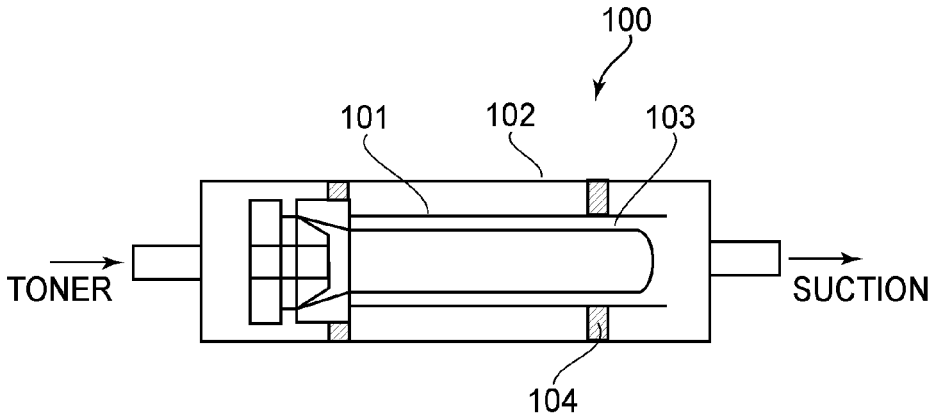
FIG. 10 is a schematic view showing a cylindrical filter for measuring an average toner charge amount Q/M.

By using Faraday cylinder 100 including inner and outer metal cylinders 101 and 102 which are different in axis diameter and are coaxially disposed and including a filter 103 for incorporating the toner into the inner cylinder 101, as shown in FIG. 10, the toner on the photosensitive drum is subjected to air suction. In the Faraday cylinder 100, the inner cylinder 101 and the outer cylinder 102 are electrically insulated by an insulating member 104. When the toner is incorporated into the inner cylinder 101 through the filter 103, electrostatic induction due to the toner charge amount Q is produced. The thus indicated charge amount Q is measured by using a coulomb meter ("616 DIGITAL ELECTROMETER", mfd. by Keithley Instruments Inc.) and then dividing the value of Q by a toner weight M in the inner cylinder to determine a value of Q/M.

<Measuring Method of Charging Efficiency>

In order to evaluate the image density, the charging efficiency was employed. The charging efficiency was measured in the following manner.

On the photosensitive drum, an electrostatic image for a slid image was formed by adjusting a degree of charging and light exposure so as to provide a maximum density portion electrostatic image potential VL of −150 V and a non-image portion potential VD of −550 V. The thus formed electrostatic image was developed into the solid image by adjusting the DC component Vdc of the developing bias at −400 V. Then, by using the surface electrometer Vs, a toner layer surface potential Vt at the surface of the photosensitive drum immediately after the development at the maximum density portion (solid portion) was measured to determine a charging potential ΔV of the toner subjected to the development according to the formula: ΔV=|Vt−VL|. Then, by using the charging potential ΔV and the developing contrast Vcon, the charging efficiency was obtained by the formula: (charging efficiency)=(ΔV/Vcon)×100%.

<Measuring Method of Granularity (GS)>

In order to evaluate the image uniformity, granularity at a low density portion at which density non-uniformity was conspicuous was employed. The granularity was measured in the following manner.

On the photosensitive drum, digital latent images were formed at 16 tone gradation levels and were then subjected to development, transfer, and fixation to obtain output images at the 16 tone gradation levels. A value of the granularity (GS) when lightness L* of the output image was 75 was calculated in the following manner.

(Calculating Method of Granularity (GS))

For measurement of granularity in silver halide photography, RMS granularity $\sigma_D$ which is standard deviation of density distribution Di is generally used. A condition thereof is defined in ANSI PJ-2.40-1985 (root mean square (rms) granularity of film).

$$\sigma_D = \sqrt{\frac{1}{N}\sum_{i=1}^{N}(D_i - \overline{D})^2}$$

Further, measurement of the granularity by using Wiener spectrum which is a power spectrum for density fluctuation has also been proposed. Specifically, the Wiener spectrum of an image is multiplied by visual transfer frequency (VTF), followed by integration to obtain a value of granularity (GS). A large value of GS represents poor granularity.

$$GS=\exp(-1.8\overline{D})\int\sqrt{WS(u)}\cdot \mathrm{VTF}(u)du$$

In this formula, u represents a spatial frequency, WS(u) represents the Wiener spectrum, and BTF(u) represents the visual transfer frequency (visual property of spatial frequency). Further, an item of $\exp(-1.8\overline{D})$ is a function using an average density $\overline{D}$ for correcting a difference between the density and lightness of human perception (R. P. Dooley, R. Shaw, "Noise Perception in Electrophotography", J. Appl. Photogr. Eng. 5(4)).

<Experiment 1>

First, in this experiment, the image formation evaluation was performed by using the conventionally known developing bias waveform shown in FIG. 3 in order to properly evaluate the effect of the image forming apparatus of the present invention to determine criterion for evaluation of the image density and the image uniformity in subsequent Experiments 2 to 4.

Figure 11:
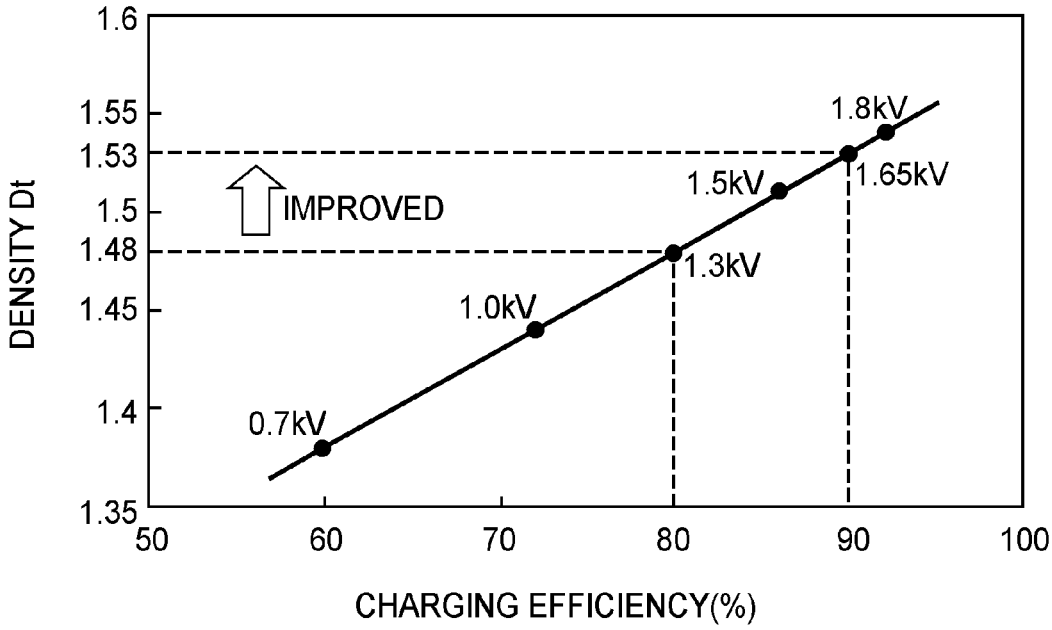
FIG. 11 is a graph showing a relationship between a charging efficiency and a transmission density measured in Experiment 1.

In Experiment 1, the image formation evaluation was performed by changing the peak-to-peak voltage Vpp from 0.7 kV to 1.8 kV while setting the developing bias DC component Vdc at −400 V (i.e., Vcon=250 V). FIG. 11 is a graph showing a relationship between a measured value of the charging efficiency (%) taken as an abscissa and a transmission density Dt of the solid image after fixation, taken as an ordinate, measured in a red-filter mode by using a transmission densitometer ("TD904", mfd. by Gratag Macbeth).

From a result of FIG. 11, it was confirmed that the charging efficiency and the transmission density Dt provided a linear correlation to permit evaluation of the image density by measuring the charging efficiency.

Further, in the case where the developing bias peak-to-peak voltage Vpp is 1.65 kV or more, white spots were caused to occur in the image at the high density portion in some instances. This may be attributable to an occurrence of leakage due to the potential difference between the developing sleeve and the photosensitive drum. For this reason, in order to make evaluation under a stable developing condition, the developing bias when the peak-to-peak voltage Vpp of the waveform shown in FIG. 3 is 1.3 kV was taken as a reference developing bias. When Vpp is 1.3 kV, the developing-side peak voltage value is −1050 V, so that the image formation evaluation was performed also in Experiments 2 to 5 described later so as to make comparison of the developing property under the same condition by setting Vdc at −400 V and setting the developing-side peak voltage value at −1050 V.

According to the measurement result of FIG. 11, when the development was effected by using the reference developing bias including Vpp=1.3 kV, the charging efficiency was 80% and the transmission density Dt of 1.48. With reference to this reference image (Dt=1.48), the transmission density Dt of the output image by which a significant effect in improving the image density was confirmed was 1.53 (corresponding to the charging efficiency of 90%). That is, when the charging efficiency was 1.13 times that of the reference image, there was the effect on the image density on the basis of that of the reference image. Based on this result, the following criterion was set as the criterion for evaluation of the output image in Experiment 2 to Experiment 5.

When a ratio of the measured charging efficiency to the charging efficiency of the reference image is taken as C.E.I.R. (charging efficiency increase ratio), the criterion for C.E.I.R. is set as follows.

(a): C.E.I.R. of 1.18 or more (considerably effective)

(b): C.E.I.R. of 1.13 or more and less than 1.18 (effective)

(c): C.E.I.R. of less than 1.13 (not effective)

Further, when the granularity (GS) of the reference image was measured, the granularity (GS) was 0.184. Based on this result, the following criterion was set as the criterion for the image uniformity of the output image in Experiment 2 to Experiment 5.

(a): granularity (GS) of less than 0.170 (very good image uniformity)

(b): granularity (GS) of 0.170 or more and less than 0.185 (good image uniformity)

(c): granularity (GS) of 0.185 or more (with no effect with respect to image uniformity)

(d): unmeasurable granularity (GS) due to occurrence of image defect such as white spot (practically unacceptable)

<Experiment 2>

In Experiment 2, an embodiment of the present invention is provided. Further, in this experiment, it is clarified that the value of $\{(S1-1.28\times S2)\times f/Vcon\}\times\exp(-2.0\times10^{-5}\times f/Hz)$ is proportional to the above-described charging efficiency change ratio and that a significant effect on the image density is achieved in the range of: $\{(S1-1.28\times S2)\times f/Vcon\}\times\exp(-2.0\times10^{-5}\times f/Hz)\geqq0.82$.

That is, it is clarified that the parameter $G=\{(S1-k\times S2)\times f/Vcon\}\times\exp(-a\times f/Hz)$ is proportional to the charging efficiency increase ratio when k=1.28 and $a=2.0\times10^{-5}$. Further, in this case, it is clarified that the charging efficiency increase ratio is 1.13 or more when $G\geqq0.82$, thus being effective in improving the image density.

It is further clarified that when the frequency is in the range of 5 kHz≦f≦10 kHz, the image with good image uniformity can be formed in the range of: $0.42\times Vpp/T\leqq|\alpha|\leqq0.89\times Vpp/T$.

The image formation evaluation was performed by using, as the developing bias, DS bias waveforms obtained by amplifying respective DS signal waveforms with the high voltage source by changing a waveform condition in such a manner that the duty ratio of the DS signal waveform was changed in the range of: $0.6\leqq\eta sign\leqq0.8$ and the frequency was changed in the range of: 3 kHz≦f≦12 kHz. A result shown in Table 1 was obtained with respect to the charging efficiency and a result shown in Table 2 was obtained with respect to the granularity.

In Tables 1 and 2, the duty ratio ηbias calculated from the DS granularity waveform is employed. In an area bordered with a thick (wide) line in Table 1, a ratio of the charging efficiency to that of the reference image is 1.13 or more. In an area bordered with the thick line in Table 2, the granularity (GS) is less than 0.185 and thus the image with good image uniformity is obtained.

From the above results of this experiment, it was found that the sufficient image density can be obtained and the image with good image uniformity can be formed under the developing bias condition providing the results in the area bordered with the thick line in each of Table 1 and Table 2.

TABLE 1

Charging Efficiency Increase Ratio (DS Bias Waveform)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 0.95 (c) |
| | 0.55 | 1.10 (c) | 1.08 (c) | 1.08 (c) | 1.05 (c) | 1.00 (c) | 1.00 (c) |
| | 0.60 | 1.15 (b) | 1.13 (b) | 1.16 (b) | 1.15 (b) | 1.10 (c) | 1.08 (c) |
| | 0.65 | 1.18 (a) | 1.18 (b) | 1.19 (a) | 1.18 (a) | 1.13 (b) | |
| | 0.70 | 1.25 (a) | 1.23 (a) | 1.23 (a) | 1.20 (a) | | |
| | 0.75 | 1.29 (a) | 1.28 (a) | | | | |

TABLE 2

GS (DS Bias Waveform)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 0.187 (c) |
| | 0.55 | — (d) | — (d) | — (d) | — (d) | 0.189 (c) | 0.169 (a) |
| | 0.60 | — (d) | 0.208 (c) | 0.181 (b) | 0.177 (b) | 0.168 (a) | 0.160 (a) |
| | 0.65 | 0.213 (c) | 0.201 (c) | 0.174 (b) | 0.165 (a) | 0.157 (a) | |
| | 0.70 | 0.205 (c) | 0.191 (c) | 0.166 (a) | 0.161 (a) | | |
| | 0.75 | 0.192 (c) | 0.187 (c) | | | | |

<Developing Bias Waveform Condition>

Consideration for obtaining a condition for the sufficient image density, i.e., $\{(S1-1.28\times S2)\times f/Vcon\}\times\exp(-2.0\times 10^{-5}\times f/Hz)$ based on the results in Experiment 2 was made.

In Table 3 and Table 4, values of the developing area S1 and the collecting area S2 when the frequency f and the duty ratio ηbias of the DS bias waveform are changed are shown, respectively. The developing area S1 and the collecting area S2 were calculated in the following manner.

First, the developing bias potential outputted from the high voltage source was decreased to 1/1000 by using a high voltage probe "P6015A", mfd. by Tektronix, Inc.) and then a developing bias waveform is captured by using a digital oscilloscope ("DPO4034", mfd. by Tektronix, Inc.). Further, by using an averaging function of the digital oscilloscope, averaging of a waveform corresponding to 64 periods is made and then sampling of 5000 pieces of potential data is performed at regular time intervals with respect to one period of the averaged waveform. Next, the sum of differences between a set VL value and the respective values of the potential data in the developing period or the sum of differences between the set VL value and the respective values of the potential data in the collecting period is calculated and is multiplied by a time interval T/5000 of the potential data (5000 pieces) to obtain the values of the developing area S1 and the values of the collecting area S2.

By using the values of the developing area S1 and the values of the collecting area S2 shown in Table 3 and Table 4, respectively, the condition of: $\{(S1-1.28\times S2)\times f/Vcon\}\times\exp(-2.0\times 10^{-5}\times f/Hz)\geqq 0.82$ was derived in a manner described below.

TABLE 3

Developing Area S1(V × msec)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 28.3 |
| | 0.55 | 123 | 90.9 | 71.9 | 59.3 | 38.5 | 24.4 |
| | 0.60 | 111 | 82.4 | 59.5 | 49.3 | 32.5 | 21.7 |
| | 0.65 | 101 | 74.9 | 54.3 | 45.2 | 28.5 | |
| | 0.70 | 91.4 | 68.1 | 50.9 | 42.4 | | |
| | 0.75 | 84.8 | 63.6 | | | | |

TABLE 4

Collecting Area S2(V × msec)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 7.76 |
| | 0.55 | 41.0 | 29.5 | 22.7 | 18.3 | 11.1 | 3.79 |
| | 0.60 | 29.0 | 20.7 | 9.92 | 7.94 | 4.69 | 0.89 |
| | 0.65 | 18.0 | 13.0 | 4.54 | 3.64 | 0.75 | |
| | 0.70 | 8.50 | 5.98 | 0.93 | 0.81 | | |
| | 0.75 | 1.70 | 1.20 | | | | |

First, in order to determine the coefficients k and a for the parameter $G=\{(S1-k\times S2)\times f/Vcon\}\times\exp(-a\times f/Hz)$, the values of S1 and S2 shown in Table 3 and Table 4 and various values of k and a were used for calculating the values of G.

When the values of G in a table prepared by using the above-described values of k and a are proportional to corresponding measured values of the charging efficiency increase ratio, taken as J, shown in Table 1, a relationship between G and J can be represented by the following formula.

$$J=\beta G\ (\beta\text{: constant})$$

When a value of J for i-th waveform condition is taken as Ji and a value of G for the i-th waveform condition is taken as Gi, the following formula is satisfied.

$$\beta i=Ji/Gi\ (\beta i\text{: constant})$$

In this case, a mean square error μ is represented by the following formula.

$$\mu=\frac{1}{N-1}\sqrt{\sum_{i=1}^{N}(\langle\beta\rangle-\beta i)^2}=\frac{1}{N-1}\sqrt{\sum_{i=1}^{N}(\langle J/G\rangle-Ji/Gi)^2}$$

When the coefficients k and a are provided so as to minimize the value of μ, G and J (charging efficiency increase ratio) establish a best proportional relationship.

Incidentally, in the above formula, <β> represents an arithmetic mean of βi and <J/G> represents an arithmetic mean of Ji/Gi.

Figure 12:
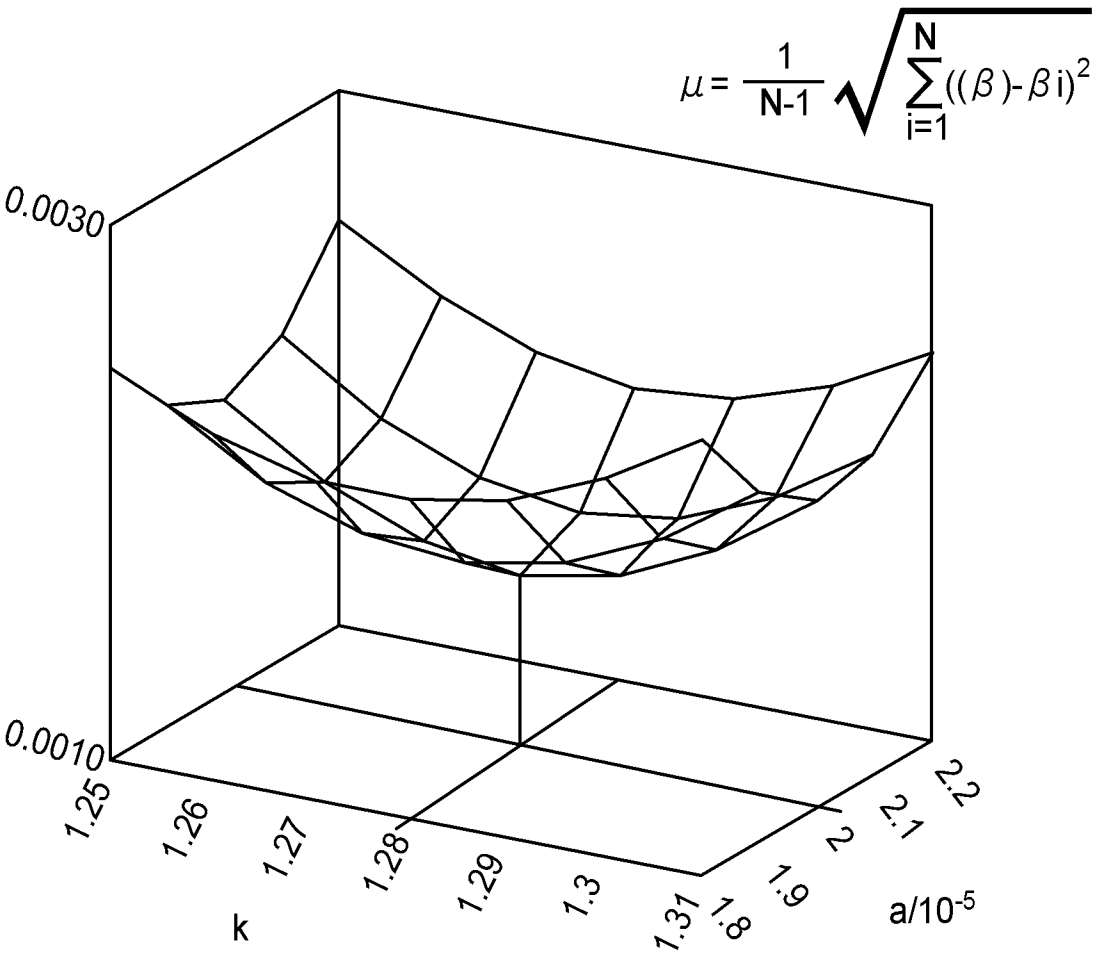
FIG. 12 is a graph for calculating k and a so that a value of $G=\{(S1-k\times S2)\times f/Vcon\}\times\exp(-a\times f/Hz)$ is proportional to a developing efficiency.

FIG. 12 illustrates a plot of the mean square error μ of βi when the values of G are calculated while changing the values of k and a in the ranges of: $1.25\leqq k\leqq 1.31$ and $1.8\times 10^{-5}\leqq a\leqq 2.2\times 10^{-5}$. From the resultant graph, it is understood that the value of μ is minimum when $k=1.28$ and $a=2.0\times 10^{-5}$.

Table 5 shows a calculation result of the values of G when $k=1.28$ and $a=2.0\times 10^{-5}$.

TABLE 5

$G = \{(S1 - 1.28 \times S2) \times f/Vcon\} \times \exp(-2.0 \times 10^{-5}\ f/Hz)$

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 0.694 |
| | 0.55 | 0.797 | 0.785 | 0.775 | 0.764 | 0.731 | 0.738 |
| | 0.60 | 0.835 | 0.826 | 0.847 | 0.833 | 0.797 | 0.776 |
| | 0.65 | 0.881 | 0.861 | 0.878 | 0.863 | 0.829 | |
| | 0.70 | 0.910 | 0.893 | 0.900 | 0.881 | | |
| | 0.75 | 0.934 | 0.917 | | | | |

Figure 13:
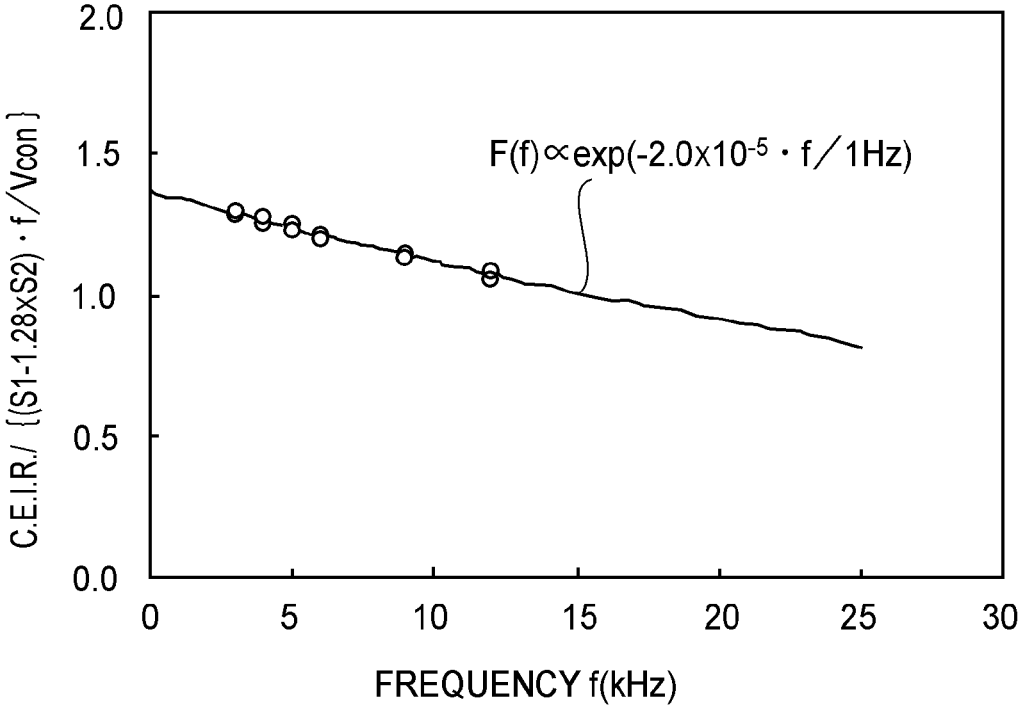
FIG. 13 is a graph showing a relationship between a developing property and a frequency of a developing bias.

FIG. 13 illustrates a plot of values of the charging efficiency increase ratio divided by the parameter: {(S1−1.28×S2)×f/Vcon} which is proportional to momentum provided to the toner per unit time during the development, with respect to the frequency f. That is, FIG. 13 shows dependency of a developing efficiency on the developing bias frequency. From the resultant graph, in the image formation evaluation in this experiment, a lowering in frequency with an increase in frequency can be approximated with an exponential function represented by the following formula:

$$F(f) \propto \exp(-2.0\times10^{-5}\times f/Hz)$$

Figure 14:
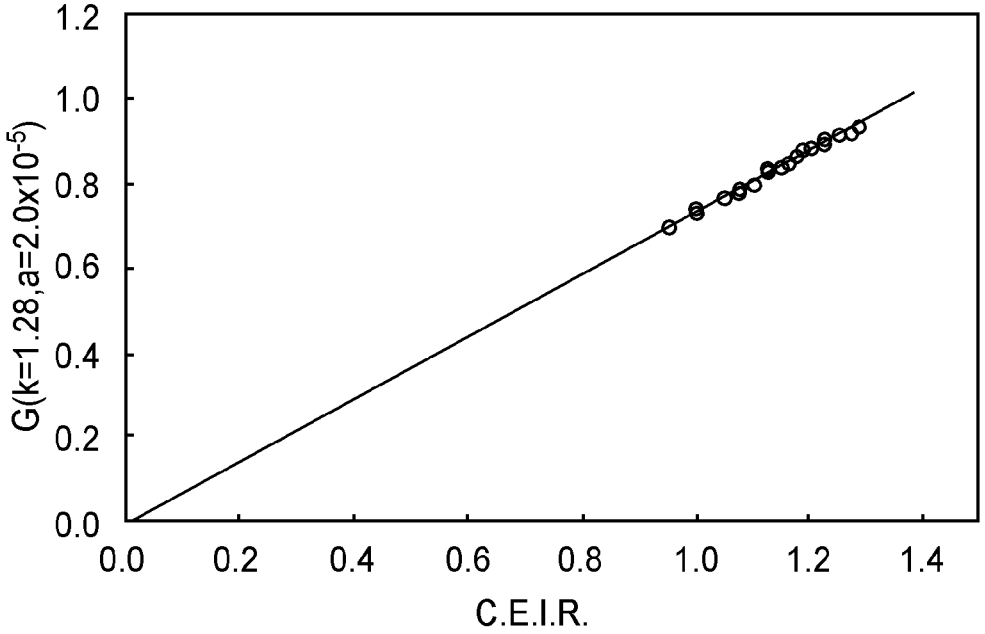
FIG. 14 is a graph showing a relationship between a value of $\{(S1-1.28\times S2)\times f/Vcon\}\times\exp(-2.0\times10^{-5}\times f/Hz)$ and a charging efficiency increase ratio.

FIG. 14 illustrates a plot of values of G and J (the charging efficiency increase ratio) in respective bias waveform conditions when k=1.28 and a=$2.0\times10^{-5}$. From the resultant graph, it can be confirmed that G and J establish the proportional relationship when k=1.28 and a=$2.0\times10^{-5}$.

By bringing the measured result of the charging efficiency in Table 1 and the calculated result of G in Table 5 into correspondence with each other, it was found that G≧0.82 is satisfied in an area, bordered with the thick line, in which an effect of improving the image density was achieved (the area in which the charging efficiency increase ratio is 1.13 or more in Table 1).

From the above-described consideration, in order to obtain a sufficient image density, it was found that it is necessary to employ such a developing bias that the developing area S1, the collecting area S2, and the frequency of satisfy the following formula.

$$\{(S1-1.28\times S2)\times f/Vcon\}\times\exp(-2.0\times10^{-5}\times f/Hz)\geqq0.82$$

The former portion of the left side, i.e., {(S1−1.28×S2)×f/Vcon} satisfies {(S1−1.28×S2)×f/Vcon}≦1 in principle even in any of developing bias waveforms providing various values of S1 and S2. For this reason, an upper limit value of the frequency f of the bias waveform satisfying the above formula is restricted by the condition: $\exp(-2.0\times10^{-5}\times f/Hz)\geqq0.82$. That is, the range of the frequency f satisfying this condition is f≦10 kHz.

Next, consideration for obtaining a condition for effecting image formation with good image uniformity, i.e., 5 kHz≦f≦10 kHz and 0.42×Vpp/T≦|α|≦0.89×Vpp/T was made.

Table 6 shows values of a parameter H represented by: H=|α|×T/Vpp by using values of a and Vpp when the frequency f and the duty ratio ηbias of the DS bias waveform are changed. The values of α and Vpp are calculated in the following manner.

The potential data of the developing bias waveform captured by the digital oscilloscope used for calculating the developing area S1 and the collecting area S2 is employed. A slope of 50 pieces of potential data, before and after the time when the developing bias voltage reaches VL during the change from the developing-side peak voltage to the collecting-side peak voltage, subjected to linear approximation through the method of least squares is obtained to determine the voltage change rate α. Further, Vpp is measured by using a peak-to-peak voltage measuring function of the digital oscilloscope.

TABLE 6

$H = |\alpha| \times T/Vpp$

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.50 | | | | | | 1.39 |
| | 0.55 | 0.97 | 0.98 | 1.01 | 1.05 | 1.22 | 0.89 |
| | 0.60 | 0.81 | 0.81 | 0.83 | 0.69 | 0.76 | 0.56 |
| | 0.65 | 0.67 | 0.67 | 0.54 | 0.55 | 0.48 | |
| | 0.70 | 0.54 | 0.54 | 0.42 | 0.43 | | |
| | 0.75 | 0.41 | 0.42 | | | | |

When the calculation results of the values of H in Table 6 was brought into correspondence with the evaluation result of the image uniformity in Table 2, it was found that the image uniformity was improved with a decreasing value of H at the frequency f in the range of: 5 kHz≦f≦12 kHz and that the image with good image uniformity was obtained in the range of: 0.42≦H≦0.89. It was also found that with respect to the uniformity of the output image, density non-uniformity was conspicuous in the range of: f≦5 kHz irrespective of the value of H.

From the above results, in order to effect the image formation with good image uniformity, it is necessary to satisfy the following conditions:

$$5\ kHz \leqq f \leqq 12\ kHz, \text{ and}$$

$$0.42\times Vpp/T \leqq |\alpha| \leqq 0.89\times Vpp/T.$$

Further, the upper limit value of the developing bias frequency of satisfying: {(S1−1.28×S2)×f/Vcon}×exp(−2.0×$10^{-5}$×f/Hz) satisfies: f≦10 kHz as described above. Therefore, in order to improve the image density and effect the image formation with good image uniformity, it was found that it is necessary to satisfy the following conditions:

$$\{(S1-1.28\times S2)\times f/Vcon\}\times\exp(-2.0\times10^{-5}\times f/Hz),$$

$$5\ kHz \leqq f \leqq 10\ kHz, \text{ and}$$

$$0.42\times Vpp/T \leqq |\alpha| \leqq 0.89\times Vpp/T.$$

<Experiment 3>

In Experiment 3, as the signal waveform to be inputted into the high voltage source, a waveform obtained by providing a rest period (a period in which only the DC voltage is applied) immediately after the AC waveform (waveform portion) is employed.

As the AC waveform, a DS waveform including the duty ratio ηsign of 0.75 and the frequency f of 6 kHz and including one period T of the AC waveform constituted by a collecting-side potential waveform and a developing-side potential waveform. The rest period and one period T of the AC waveform have the same time length.

Figure 15:
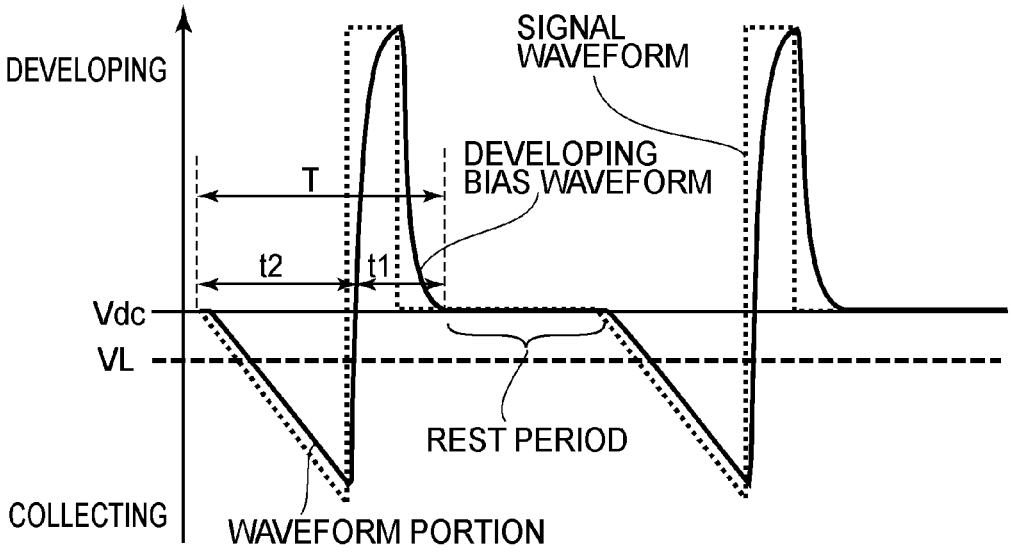
FIG. 15 is a diagram showing a developing bias waveform used for image formation evaluation in Experiment 3.

This signal waveform was amplified by the high voltage source to obtain an output waveform indicated by the solid line in FIG. 15. In FIG. 15, the output waveform has about two periods. The image formation evaluation was performed by using the thus-obtained waveform as the developing bias. As a result, the charging efficiency increase ratio was 1.18 and the granularity (GS) was 0.160.

From this result, it was found that the developing bias waveform in the present invention was capable of providing the sufficient image density and the output image with good image uniformity even when a certain rest period was provided immediately after the developing period, in addition to repetition of the developing period and the collecting period.

<Experiment 4>

Figure 4:
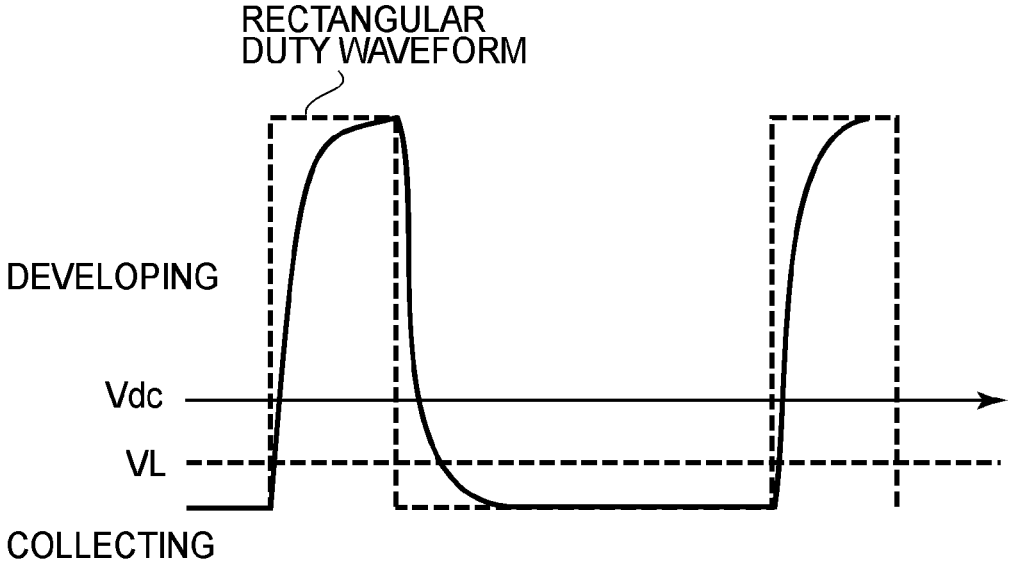
FIG. 4 is a diagram showing a rectangular duty waveform.

In Experiment 4, study similar to that in Experiment 2 was made by using the rectangular duty bias waveform shown in FIG. 4.

The image formation evaluation was performed by using DS bias waveforms obtained by amplifying respective DS signal waveforms, with the high voltage source, obtained by changing the waveform condition in such a manner that the duty ratio ηsign of the rectangular duty signal waveform to be applied to the high voltage source was changed in the range of: 0.6≦ηsign≦0.8 and the frequency f was changed in the range of: 3 kHz≦f≦12 kHz. A result shown in Table 7 was obtained with respect to the charging efficiency and a result shown in Table 8 was obtained with respect to the granularity.

Further, similarly as in Experiment 2, in an area bordered with the thick line in Table 7, the charging efficiency increase ratio is 1.13 or more and thus improvement in image density with respect to the reference image is confirmed. In an area bordered with the thick line in Table 8, the granularity (GS) is less than 0.195 and thus the image with good image uniformity is obtained.

According to these results, in the case of using the rectangular duty bias as the developing bias, there is no area in which a sufficient image density-providing area and good uniformity image-providing area overlap with each other. That is, it was confirmed that it was difficult to compatibly realize the sufficient image density and the image uniformity in the case of using the conventional rectangular duty bias.

TABLE 7

Charging Efficiency Increase Ratio (Duty Bias Waveform)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.55 | | | | | | 0.93 (c) |
| | 0.60 | 1.08 (c) | 1.05 (c) | 1.04 (c) | 1.03 (c) | 0.95 (c) | 0.93 (c) |
| | 0.65 | 1.10 (c) | 1.10 (c) | 1.10 (c) | 1.10 (c) | 1.10 (c) | 0.95 (c) |
| | 0.70 | 1.15 (b) | 1.13 (b) | 1.10 (c) | 1.10 (c) | 1.05 (c) | 1.00 (c) |
| | 0.75 | 1.20 (a) | 1.15 (b) | 1.11 (c) | 1.10 (c) | | |

TABLE 8

GS (Duty Bias Waveform)

| | | f | | | | | |
|---|---|---|---|---|---|---|---|
| | | 3 kHz | 4 kHz | 5 kHz | 6 kHz | 9 kHz | 12 kHz |
| $\eta_{bias}$ | 0.55 | | | | | | 0.192 (c) |
| | 0.60 | — (d) | — (d) | — (d) | — (d) | 0.196 (c) | 0.189 (c) |
| | 0.65 | — (d) | — (d) | — (d) | 0.199 (c) | 0.184 (b) | 0.184 (b) |
| | 0.70 | — (d) | — (d) | 0.201 (c) | 0.184 (b) | 0.182 (b) | 0.180 (b) |
| | 0.75 | — (d) | 0.207 (c) | 0.196 (c) | 0.182 (b) | | |

<Experiment 5>

In Experiment 5, the image formation evaluation was performed by using the waveforms shown in FIGS. 9(A'), 9(B'), 9(C') and 9(D') as the developing bias.

Table 9 shows values of waveform parameters ηsign, f, Vpp, G, α, and H in the waveforms shown in FIGS. 9(A'), 9(B'), 9(C') and 9(D'). As described above, these values are calculated from the developing bias waveform data captured by the digital oscilloscope.

TABLE 9

Waveform Parameters

| | Waveform | | | |
|---|---|---|---|---|
| | (A') | (B') | (C') | (D') |
| $\eta_{bias}$ | 0.48 | 0.60 | 0.58 | 0.64 |
| f | 6 kHz | 6 kHz | 6 kHz | 6 kHz |
| Vpp | 1.54 kV | 1.00 kV | 1.14 kV | 1.18 kV |
| G | 0.70 | 0.84 | 0.78 | 0.80 |
| \|α\| | 12.5 kV/msec | 22.5 kV/msec | 10.5 kV/msec | 38.0 kV/msec |
| H | 1.35 | 3.75 | 1.54 | 5.37 |

Table 10 shows a result of the image formation evaluation with respect to the respective waveforms of FIGS. 9(A'), 9(B'), 9(C') and 9(D'), i.e., evaluation results of the charging efficiency increase ratio and the granularity (GS).

TABLE 10

Image Evaluation Results

| | Waveform | | | |
|---|---|---|---|---|
| | (A') | (B') | (C') | (D') |
| Increase Ratio | 1.05 (c) | 1.15 (b) | 1.00 (c) | 0.83 (c) |
| Granularity GS | 0.195 (c) | 0.189 (c) | 0.187 (c) | — (d) |

According to this result, in the case of using the developing bias which did not satisfy the above-described formula (condition) (3) as in the waveforms of FIGS. 9(A') and 9(C'), a sufficient image density was not obtained.

Further, as in the waveform of FIG. 9(B'), in the case where the formula (3) was satisfied but the formula (2) was not satisfied, the charging efficiency increase ratio was 1.15 and thus the effect on the image density was confirmed. However, the effect on the image uniformity was not obtained.

In the waveform of FIG. 9(D'), the formula (condition) (3) was not satisfied, so that the effect on the image density was not confirmed. The reason for this will be described later. Further, the formula (2) was also not satisfied, so that the effect on the image uniformity was not obtained.

From the above study, in the case where the waveforms of FIGS. 9(A') to 9(D') in the comparative embodiment were used as the developing bias, it was shown that there was no effect on the image density and the image uniformity.

Based on the results of the study including the above-described Experiment 1 to Experiment 5, it was clarified that the sufficient image density was obtained and the image with good image uniformity was able to be formed by using the image forming apparatus of the present invention.

Incidentally, in the above-described Experiments, a two component developer having an average toner charge amount (Q/M) satisfying: 30 μC/g≦|Q/M|≦100 μC/g was prepared in the following manner. First, a carrier having high charge-imparting ability was prepared by adjusting an amount of charge control agent to be added into a surface-coating resin material and an amount of the resin material in a carrier production step. Then, toner was prepared by adjusting the kind of an external additive to be externally added to a toner surface or an amount of the external additive, so as to provide a proper charge amount by mixing with the carrier, in a toner production step.

<Consideration of Results of Experiments 1 to 5>

Consideration of the results of the above-described Experiment 1 to Experiment 5 will be made and also the reason why the effects of the present invention can be obtained by the image forming apparatus of the present invention will be described.

First, the reason why the sufficient image density can be obtained and also the output image with good image uniformity can be formed by the image forming apparatus of the present invention when the toner having the average toner charge amount (Q/M) satisfying: 30 μC/g≦|Q/M|≦100 μC/g is used for the development is as follows. That is, the reason can be explained by comparing an effective DS bias waveform with an ineffective rectangular duty bias waveform while focusing attention on a behavior of the toner in the developing area.

(Effect 1: Improvement in Image Density)

The reason why the sufficient image density can be obtained at the high density portion by the image forming apparatus of the present invention will be described by comparing the DS bias waveform with the rectangular duty bias waveform.

Generally, in the case of the developing bias waveform having a duty ratio (ηbias) satisfying: 0.55≦ηbias≦0.8, there is a tendency that a larger value of ηbias is advantageous in terms of the image density. This is because when the duty ratio ηbias is increased while fixing the developing-side peak voltage Vdc, the collecting-side peak voltage is decreased, so that an electric field for collecting the toner used for the development on the image bearing member toward the developer carrying member is weakened.

Further, it has been known that the image density is improved in general when Vpp as a difference between the developing-side peak voltage and the collecting-side peak voltage in the developing bias.

Thus, it is understood that a magnitude and ratio of the developing-side voltage value and the collecting-side voltage value which are determined by setting of the duty ratio ηbias and Vpp in the developing bias influence the image density.

In another aspect, a final amount of the toner to be subjected to the development is affected by not only the voltage value of the developing bias but also the developing period and the collecting period in one period of the developing bias waveform.

Figure 16:
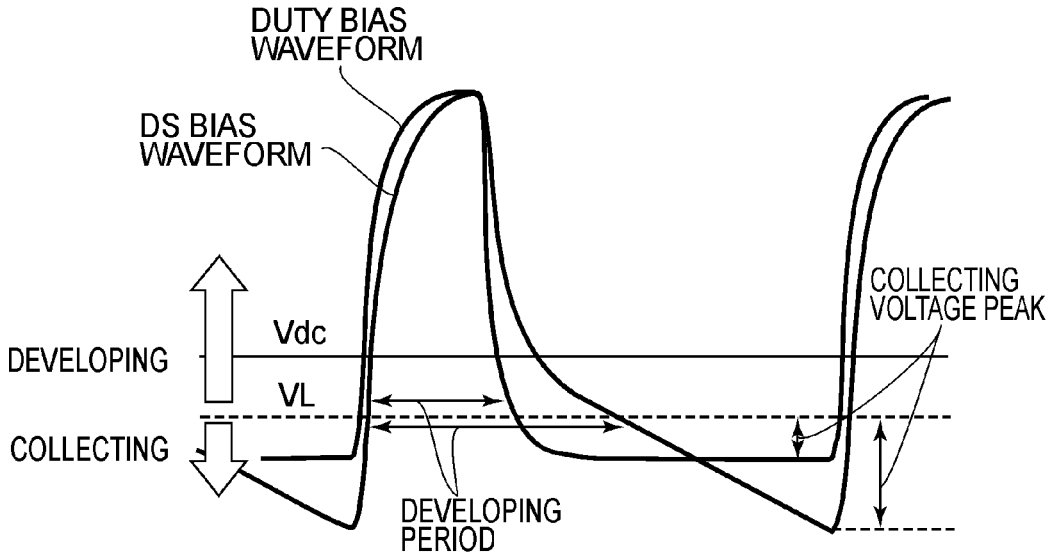
FIG. 16 is a comparison diagram with respect to developing periods of a DS bias waveform and a rectangular duty waveform, and a collecting-side peak voltage.

With respect to the developing period, when the DS bias waveform and the rectangular duty bias waveform are compared, as shown in FIG. 16, a period in which the toner is acceleratingly moved toward the developing-side during one period with respect to the DS bias is longer than that with respect to the rectangular duty bias. On the other hand, the collecting period in the developing sleeve bias is shorter than that in the rectangular duty bias. For this reason, it is considered that the DS bias is advantageous compared with the rectangular duty bias in terms of improvement in image density.

(Effect 2: Improvement in Image Uniformity)

The reason why the image uniformity is improved while keeping the sufficient image density by the image forming apparatus of the present invention can be explained as follows.

In the image forming apparatus in which the electrostatic image on the image bearing member is developed by applying the AC developing bias to the developer carrying member, the developing and collecting of the toner are repeated by the AC developing bias. As a result, it has been known that the toner is caused to reciprocate in the developing area in which the image bearing member and the developer carrying member oppose to each other to properly control the amount of the toner finally subjected to the development, thus providing the image with good image uniformity.

That is, in the developing bias, the magnitude of the developing-side peak voltage considerably influences the image uniformity.

However, from the result of Experiment 3, in the case where the toner having the average toner charge amount (Q/M) satisfying: |Q/M|≧30 μC/g is subjected to the development, it has been found that it is difficult to obtain good image uniformity while keeping the sufficient image density when the voltage change shape on the collecting side of the AC developing bias is rectangular. This may be attributable to the following phenomenon.

The toner having the average toner charge amount of 30 μC/g or more in terms of an absolute value has a large electrostatic depositing force on the image bearing member when the toner is once subjected to the development on the image bearing member. For this reason, when the collecting-side voltage value of the developing bias is insufficient, the toner cannot produce reciprocating motion between the image bearing member and the developer carrying member, so that the good image uniformity cannot be obtained. Further, even in the case where the collecting side voltage value is sufficiently increased by increasing the value of Vpp, when the voltage is changed in a rectangular manner, the collecting period thereof is longer than that of the DS bias. In this case, due to a large toner charge amount, the toner is considerably returned toward the developer carrying member side, that an amplitude of the reciprocating motion of the toner is increased. As a result, proper re-arrangement of toner particles cannot be effected, so that the image uniformity is less liable to be improve significantly. Further, an amount of finally collected toner is increased, thus adversely affecting also the image density.

In the case of the image forming apparatus of the present invention, by providing a gentle slope to the voltage change during the transition of the developing bias voltage value from the developing side to the collecting side with respect to VL, the collecting period is shortened and a degree of acceleration of the return of the toner from the image bearing member is alleviated. For that reason, a range of the reciprocating motion is limited to a portion in the neighborhood of the image bearing member. As a result, it is considered that the toner re-arrangement is stably performed to improve the image uniformity. Further, it is considered that the amount of finally collected toner is decreased, thereby to maintain the sufficient image density and obtain the good image uniformity.

For the reasons described above, in the image forming apparatus of the present invention, the voltage change ratio $\alpha$ during the transition of the developing bias voltage from the developing side to the collecting side through VL is decreased, so that the slope of the voltage change during the returning is gentled. As a result, it is considered that the toner image improved in image density and with good image uniformity can be formed.

Further, the reason why improvement in image uniformity was not confirmed at the developing bias frequency f satisfying: f <5 kHz even when the voltage change ratio $\alpha$ is decreased is presumably as follows. When the frequency of the reciprocating motion of the toner in the developing area is decreased by decreasing the developing bias frequency, the reciprocating motion frequency is consequently reproduced as a spatial frequency with respect to the output image, so that the resultant density non-uniformity is recognized as non-uniformity of the image.

The range of the developing bias duty ratio $\eta$bias can be:

$$0.55 \leqq \eta bias \leqq 0.80 \quad (4).$$

By satisfying this condition (4), it is possible to form the image having the sufficient image density and good image uniformity and to prevent image defect due to carrier deposition. The reason for this will be described.

As described above, $\eta$bias represents the duty ratio of the developing bias waveform and is defined as follows with reference to, e.g., FIG. 6. That is, of continuous periods in each of which the voltage value of the developing bias is changed from Vdc to the peak voltage value and then is returned to Vdc, a period in which the peak voltage provides a potential difference for collecting the toner on the developer carrying member side is taken as t2. From t2 and one period (repetition period) T, the duty ratio $\eta$bias is defined as: $\eta bias = t2/T$.

The lowering in image density with a decrease in developing bias duty ratio $\eta$bias may be attributable to a decrease in amount of the toner finally subjected to the development by an increase in amount of the collected toner resulting from an increase in peak voltage on the collecting side. Further, when the collecting-side peak voltage is large, such a phenomenon that the carrier charged to an opposite polarity to the toner charge polarity in the toner collecting period is attracted to the high density portion at the electrostatic latent image potential to be deposited on the photosensitive drum (carrier deposition) is liable to occur.

When the duty ratio $\eta$bias is increased, the collecting-side peak voltage is decreased to improve the image density but a re-arrangement effect by the reciprocating motion of the toner is lowered, so that the image with good image uniformity cannot be obtained.

For the above reason, in the range of the developing bias duty ratio $\eta$bias satisfying: $0.55 \leqq \eta bias \leqq 0.80$, it is considered that the image having the sufficient image density and good image uniformity can be formed and also the image defect due to the carrier deposition can be prevented.

The voltage change ratio (rate) during the transition of the developing bias voltage from the collecting-side peak voltage to the developing-side peak voltage can be configured to be decreased as the developing bias voltage approaches the developing-side peak voltage. The reason why the sufficient image density can be obtained by this configuration is considered.

According to the result of Experiment 5, the sufficient image density is not obtained by using the waveform of FIG. 9(D'). The reason for this can be explained as follows.

In order to separate the toner from the carrier to be subjected to the development, such a large electric field intensity that a force applied to the toner electric charges by the electric field exceeds the depositing force between the toner and the carrier is required to be created.

However, in the case of the waveform of FIG. 9(D'), the voltage change during the transition of the developing bias from the collecting-side peak voltage to the developing-side peak voltage is gentle. For that reason, actual development is started at the time when the developing bias voltage value reaches a value close to the developing-side peak voltage, not the moment at which the developing bias voltage value reaches VL. Therefore, in the waveform of FIG. 9(D') requiring some time until the developing bias voltage value reaches the developing-side peak voltage, the developing period is substantially shortened. As a result, it is considered that the sufficient image density cannot be obtained.

Thus, with respect to the developing bias, the voltage change ratio during the transition of the developing bias voltage from the collecting-side peak voltage to the developing-side peak voltage may preferably be decreased as the developing bias voltage approaches the developing-side peak voltage. That is, it is preferable that the developing bias voltage reaches the developing-side peak voltage as quickly as possible.

For this reason, in the developing bias waveform, the voltage change ratio during the transition of the developing bias voltage from the collecting-side peak voltage to the developing-side peak voltage is decreased as the developing bias voltage approaches the developing-side peak voltage.

The range of the peak-to-peak voltage Vpp of the developing bias can be:

$$0.7\ \text{kV} \leqq Vpp \leqq 2.0\ \text{kV} \quad (5).$$

By satisfying this condition (5), it is possible to form the image having the sufficient image density and the good image uniformity and to prevent an occurrence of image defect due to the carrier deposition and electric discharge (leakage) in the developing area. The reason for this is considered.

In the case where Vpp is decreased, there is a tendency that the amount of the toner subjected to the development is decreased to lower the image density. Further, in this case, the collecting-side peak voltage is also decreased, so that the re-arrangement effect by the reciprocating motion of the toner is lowered, thus resulting in lowering in image uniformity. For this reason, Vpp of the developing bias is required to have a magnitude not less than a certain level.

On the other hand, when Vpp is increased to exceed a certain value, an electric field formed at an opposing portion between the developer carrying member and the image bearing member by the potential difference between the electrostatic latent image potential on the image bearing member and the developing-side peak voltage or the collecting-side peak voltage of the developing bias exceeds an electric discharge threshold value to cause electric discharge. The electric discharge in the developing area not only disturbs the electrostatic latent image and the toner image but also breaks the image bearing member, so that it is necessary to keep the developing bias at a certain level or less. According to study by the present inventors, it has been found that the range of Vpp in which the image density and the image uniformity are compatibly realized to a certain extent and the electric discharge does not occur in the developing area is 0.7 kV≦Vpp≦2.0 kV. Further, in order to achieve the sufficient image density and to form the image with further improved image uniformity, it is effective to satisfy: 1.0 kV≦Vpp≦1.5 kV.

The developing contrast Vcon at the high density portion can be set in the range of:

$$150\ \text{V} \leqq \text{Vcon} \leqq 400\ \text{V} \quad (6).$$

By satisfying this condition (6), it is possible to form the image with good image uniformity and to obtain stable tone gradation. The reason for this is considered.

As described above, in order to obtain a stable image tone gradation property by decreasing the γ value, the high density portion developing contrast Vcon is required to be 150 V or more. The γ value is decreased with an increasing Vcon value in principle, so that stability of tone gradation is ensured. Further, the increase in Vcon value is also effective in preventing fog and in improving the image uniformity.

However, in order to increase the Vcon value, when the potential difference between Vdc and VL is excessively increased, the collecting-side peak voltage does not exceed VL, so that the potential difference for collecting the toner on the developer carrying member side is not produced. For this reason, the re-arrangement effect by the reciprocating motion of the toner cannot be obtained, so that it is considered that the image uniformity is rather exacerbated. For this reason, in order to ensure the stable image tone gradation property and to form the image with good image uniformity, the range of Vcon may preferably be: 150 V≦Vcon≦400 V.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 203656/2008 filed Aug. 6, 2008 and 181972/2009 filed Aug. 4, 2009, which are hereby incorporated by reference.

What is claimed is:

1. An image forming apparatus comprising:

an image bearing member for bearing an electrostatic image; and a developing device, including a developer carrying member for carrying a developer including a magnetic carrier and toner having an average charge amount Q/M satisfying: 30 μC/g≦|Q/M|≦100 μC/g and for feeding the developer toward an opposite portion between said developing device and said image bearing member, for developing the electrostatic image by applying to the developer carrying member a developing bias comprising a DC voltage component and an AC voltage component;

wherein the developing bias has a waveform portion including a collecting period, in which a voltage produces an electrostatic force for moving the toner toward the developer carrying member, and including a developing period in which a voltage produces an electrostatic force for moving the toner toward said image bearing member, and wherein the waveform portion satisfies the following formulas (1), (2), and (3):

$$5\ \text{kHz} \leqq f \leqq 10\ \text{kHz} \quad (1)$$

$$0.42 \times Vpp/T \leqq |\alpha| \leqq 0.89 \times Vpp/T \quad (2)$$

$$\{(S1 - 1.28 \times S2) \times f/Vcon\} \times \exp(-2.0 \times 10^{-5} \times f/\text{Hz}) \geqq 0.82 \quad (3)$$

wherein f represents a frequency of the waveform portion,

α represents a change rate of voltage per time at the time when a voltage value of the developing bias is equal to an electrostatic image potential VL, at a maximum density portion of an image formed on said image bearing member, during transition from the developing period to the collecting period, Vpp represents a peak-to-peak voltage which is a difference between a peak voltage in the developing period of the developing bias and a peak voltage in the collecting period of the developing bias, T represents a period of the waveform portion and is 1/f, S1 represents a time-integrated value of a difference between the voltage value of the developing bias and the electrostatic image potential VL in the developing period of the developing bias, S2 represents a time-integrated value of a difference between the voltage value of the developing bias and the electrostatic image potential VL in the collecting period of the developing bias, and Vcon represents a developing contrast value represented by Vcon=|Vdc−VL| where Vdc represents the DC voltage component of the developing bias.

2. An apparatus according to claim 1, wherein the waveform portion further satisfies the following formula (4):

$$0.55 \leqq \eta\text{bias} \leqq 0.80 \quad (4)$$

wherein ηbias is represented by t2/T where T represents one period of the waveform portion and t2 represents a period, in the period T, in which a voltage value of the waveform portion of the developing bias is present on a collecting period side with respect to the DC voltage component Vdc.

3. An apparatus according to claim 1, wherein a change rate of voltage during transition of the developing bias voltage from a peak voltage in the collecting period to a peak voltage in the developing period is decreased as the voltage value of the developing bias approaches the peak voltage in the developing period.

4. An apparatus according to claim 1, the peak-to-peak voltage Vpp satisfies the following formula (5):

$$0.7\ \text{kV} \leqq \text{Vpp} \leqq 2.0\ \text{kV} \quad (5).$$

5. An apparatus according to claim 1, wherein the developing contrast value Vcon satisfies the following formula (6):

$$150\ \text{V} \leqq \text{Vcon} \leqq 400\ \text{V} \quad (6).$$

* * * * *